US005979800A

United States Patent [19]

Takagi

[11] Patent Number: 5,979,800

[45] Date of Patent: Nov. 9, 1999

[54] SPRINKLER NOZZLE

[76] Inventor: Toshio Takagi, 1-7, Kamiishida 2-chome, Kokuraminami-ku, Kitakyushu, Fukuoka, Japan

[21] Appl. No.: 09/011,544

[22] PCT Filed: Aug. 1, 1996

[86] PCT No.: PCT/JP96/02186

§ 371 Date: Feb. 3, 1998

§ 102(e) Date: Feb. 3, 1998

[87] PCT Pub. No.: WO97/05958

PCT Pub. Date: Feb. 20, 1997

[30] Foreign Application Priority Data

Aug. 3, 1995 [JP] Japan ..... 7-198792
Jul. 30, 1996 [JP] Japan ..... 8-200624

[51] Int. Cl.[6] ..... B05B 1/16; B05B 1/32

[52] U.S. Cl. ..... 239/440; 239/441; 239/444; 239/526; 239/539

[58] Field of Search ..... 239/437, 438, 239/439, 440, 441, 443–446, 537–539, 526

[56] References Cited

U.S. PATENT DOCUMENTS

| | | | |
|---|---|---|---|
| 3,111,273 | 11/1963 | Mei | 239/441 X |
| 3,514,042 | 5/1970 | Freed | 239/441 X |
| 4,618,100 | 10/1986 | White et al. | 239/441 X |
| 4,776,517 | 10/1988 | Heren | 239/526 X |
| 4,785,998 | 11/1988 | Takagi . | |
| 4,909,443 | 3/1990 | Takagi | 239/538 X |
| 4,955,546 | 9/1990 | Liaw | 239/441 X |
| 5,333,792 | 8/1994 | Wang | 239/444 X |
| 5,806,770 | 9/1998 | Wang | 239/526 X |

FOREIGN PATENT DOCUMENTS

| | | | |
|---|---|---|---|
| 63-136750 | 9/1988 | Japan . | |
| 63-240960 | 10/1988 | Japan . | |
| 2-14765 | 1/1990 | Japan . | |
| 5-95662 | 12/1993 | Japan . | |
| 6-277564 | 10/1994 | Japan | 239/445 |
| 6-277565 | 10/1994 | Japan | 239/445 |

*Primary Examiner*—Lesley D. Morris
*Attorney, Agent, or Firm*—Jordan and Hamburg LLP

[57] ABSTRACT

A sprinkler nozzle capable of forming various sprinkling patterns. An inner cylinder laterally surrounds an outer periphery of a nozzle body, a gap within the inner cylinder serves as an inner flow passage, and an outer flow passage is provided outside the inner cylinder. Water from through holes formed in a peripheral wall of the nozzle body is conducted to the inner flow passage or the outer flow passage by operating reciprocatingly the inner cylinder. Further, an enlarged tip end portion formed at its peripheral wall with water flow-in holes is provided contiguous to a closed tip end of the nozzle body, and the water flow-in holes communicate with the inner flow passage so that an operation of the inner cylinder can provide various sprinkling patterns such as a straight rod, mist, cone, watering pot and shower.

7 Claims, 19 Drawing Sheets

SPRINKLER NOZZLE

TECHNICAL FIELD

Figure 1:
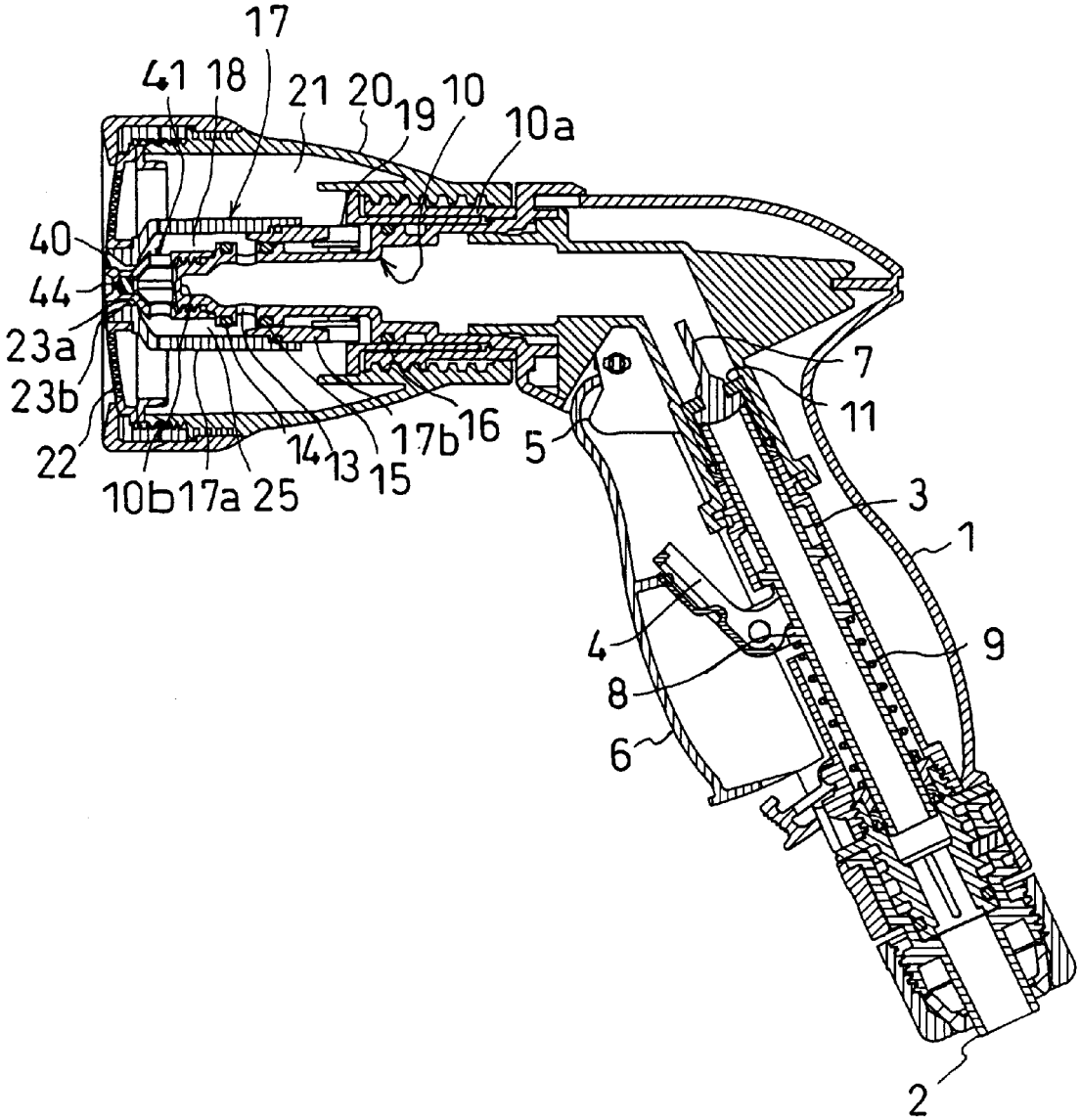

The present invention relates to a sprinkler nozzle capable of sprinkling water in a variety of sprinkling patterns, such as, in a rod-shaped form, a mist form, a cone-shaped form, a funnel-shaped form, in a shower form or in a circular state, in a fan-shaped form, or the like.

BACKGROUND ART

Hitherto, conventional sprinkler nozzles are structured so as to form such sprinkling patterns by dividing their nozzles into two sprinkling paths, opening the two sprinkling paths independently from each other or together, and adjusting the extent of the opening of the sprinkling paths, as described, for example, in Japanese Utility Model Publication No. 6-26,366 or U.S. Pat. No. 4,785,998. More specifically, such conventional sprinkler nozzles are configured such that water flowing from a holding cylinder is sprinkled in a shower state from an outer periphery of a nozzle body via through holes disposed through a peripheral wall of the nozzle body and further that the water is sprinkled in a straight state when the shower flow paths from the through holes are closed and changed to the straight flow paths by sliding a sealing member for changing the flow paths from the through holes.

With such an arrangement of the nozzles, the shower flow path and the straight flow path are arranged in such a manner that an inner cylinder is disposed to surround an outer periphery of the nozzle body with the through holes disposed through the peripheral wall thereof to form a clearance between the nozzle body and the inner cylinder as a flow path for outflowing water through the clearance in a straight state or spraying water and to form a clearance outside the inner cylinder as a shower flow path.

Further, the entire inner cylinder is structured in a state in which the inner cylinder is connected integrally to a base end of an outer casing disposed on the outer peripheral side of the inner cylinder.

Moreover, Japanese Utility Model Publication No. 5-1,319 discloses a sprinkler nozzle which is structured such that a flow path is divided into fine sections so as to provide four or more kinds of sprinkling patterns.

More specifically, the sprinkler nozzle is structured in such a way that a tip end portion of a main flow path of the sprinkling nozzle body is closed with a flow path extending from the rear portion of the closed wall and a flow path extending from the front portion thereof disposed as a basic flow path and that each flow path is further divided into plural sections to form a large number of flow paths. Further, this prior art sprinkling nozzle is so arranged as to form four kinds of such sprinkling patterns or more by adjusting the positions of inflow holes disposed on the main flow path while moving them in a forward or backward direction.

On the other hand, the sprinkler nozzle as disclosed in Japanese Utility Model Publication No. 6-26,366 or U.S. Pat. No. 4,785,998 is so structured so as to provide a sprinkling pattern, such as, in a shower, in a straight state, in a mist or the like by moving the inner cylinder in a forward or backward direction. However, particularly when water is sprayed in a mist state, there is the risk that a central portion of the water being sprinkled in a mist state is likely to become hollow, thereby forming a circle-shaped sprinkling pattern. Further, when water is sprinkled in a spraying state, there is the risk that the sprinkling distance may become extremely short. There have so far been no such sprinkler nozzles in which only one sprinkler nozzle itself can solve those defects as the conventional sprinkler nozzles have and at the same time can in turn sprinkle water in various sprinkling patterns, such as, in a mist state, in a cone-shaped form, a straight rod-shaped form, in a funnel-shaped form, in a shower state, in a circular state, in a fan-shaped form, or the like.

Moreover, those prior art sprinkler nozzle present the defects that, when a tip end portion of the nozzle body causes clogging or it is damaged, it is difficult to inspect and a damaged part of the inner cylinder should be replaced as a whole. Further, when they are assembled together, an increased number of steps for fixing the parts to each other is required so that the assembly operation becomes more complicated by the addition of those steps. Moreover, although such various sprinkling patterns can be created, they suffer from the disadvantages in terms of maintenance.

Furthermore, the sprinkler nozzle as disclosed in Japanese Utility Model Publication No. 5-1,319 may present the risks that a definite shift of the sprinkling patterns cannot be carried out because each flow path is not partitioned in a definite way so that the water flow may be mixed together in an intermediate position and that water fails to flow smoothly or a sprinkling force upon sprinkling may be hindered because there are many irregular surface portions at connection sections of each member in an intermediate region of the flow path.

The present invention has been carried out to solve the defects and disadvantages inherent in those conventional sprinkler nozzles as described hereinabove by providing a sprinkler nozzle that can sprinkle water in a variety of sprinkling patterns and that allows a flow path to be partitioned in a definite way, thereby allowing water to flow in a smooth way and reducing a flow load in a sprinkling direction as low as possible.

DISCLOSURE OF THE INVENTION

The present invention is to provide a sprinkler nozzle characterized by a hollow nozzle body in a cylinder shape with a base end thereof communicating with a hose connection part; in which the nozzle body is disposed with a tip end portion thereof closed and an outer peripheral side of the nozzle body is surrounded by an inner cylinder disposed so as to move in forward and backward directions while holding an inner flow path as a water flow space; in which a cylinder-shaped nozzle head portion with a tip end thereof disposed so as to converge is provided screwed ahead of a closed portion of the nozzle body in such a manner that the nozzle head portion is provided on a peripheral wall thereof with a predetermined number of inflow holes communicating with the inner flow path a partition wall for forming a water flow path communicating with the inflow holes is projected at the tip end of the closed portion of the nozzle body, the inner flow path is disposed at a rear end thereof so as to communicate with a nozzle outlet disposed at a tip end of the inner cylinder, and an inner peripheral side surface of the nozzle outlet is formed by a flat surface section and a tapered surface section, wherein an interval between an outer peripheral side surface of the nozzle head portion and the nozzle outlet is disposed so as to be adjusted to a mode including a closing mode by operation for a forward or backward movement of the inner cylinder; in which the nozzle body is further provided at an intermediate peripheral wall thereof with a through hole so as to communicate with the inner flow path upon the forward or backward movement of the inner cylinder and on an outer peripheral side surface ahead and behind of the through hole with a first sealing member and a second sealing member, respectively, so as to be tightly engageable with an inner peripheral wall surface of the inner cylinder disposed so as to be movable in forward and backward directions and the through hole is disposed so as to be closable by the inner peripheral wall surface of the inner cyclinder engaged tightly with the first sealing member and the second sealing member; and in which the inner cylinder is surrounded at an outer peripheral side thereof integrally by an outermost cylinder portion while holding an outer flow path as a water flow space in such a manner that the outer flow path is disposed so as to communicate with the through hole of the nozzle body upon the forward or backward movement of the inner cylinder and the outermost cylinder portion is disposed so as to move in forward and backward directions by the rotation of the outermost cylinder portion in such a state that a base portion of the outermost cylinder portion forming the outer flow path located on the outermost side is screwed with an outside portion of a casing of the nozzle body.

Further, the present invention provides the sprinkler nozzle characterized by the hollow nozzle body in a cylinder shape with a base end communicating with the hose connection part; in which the nozzle body is disposed with the tip end portion thereof closed and a peripheral wall at an intermediate portion thereof is provided with the through hole, the outer peripheral side of the nozzle body is surrounded by the inner cylinder, while holding the inner flow path as a water flow space, the nozzle body is further disposed so as to move inside the inner cylinder in forward and backward directions by the aid of the first sealing member and the second sealing member disposed on the outer peripheral side surface thereof ahead and behind the through hole, respectively and the through hole is disposed so as to be closable by the inner peripheral wall surface of the inner cylinder tightly engaged with the first sealing member and the second sealing member; in which a cylinder-shaped nozzle head portion with a tip end thereof disposed so as to converge is screwed ahead of a closed portion of the nozzle body, nozzle head portion is provided at a peripheral wall thereof with a predetermined number of inflow holes communicating with the inner flow path, a partition wall for forming a water flow path communicating with the inflow holes is projected at the tip end of the closed portion of the nozzle body, the inner flow path is disposed on a rear end thereof so as communicate with a nozzle outlet disposed at a tip end of the inner cylinder, and an inner peripheral side surface of the nozzle outlet is formed by a flat surface section and a tapered surface section, in such a manner that an interval between an outer peripheral side surface of the nozzle head portion and the nozzle outlet is disposed so as to be adjusted to a mode including a closing mode by operation for a forward or backward movement of the inner cylinder; and in which the outer peripheral side of the inner cylinder is surrounded by the outermost cylinder portion while holding the outer flow path as a water flow space and the outer flow path is structured so as to communicate with the through hole of the nozzle body by the forward and backward movement of the nozzle body, in which the rear end of the outer flow path thereof is disposed so as to communicate with a second sprinkling outlet of the sprinkling plate disposed at the tip portion of the outermost cylinder portion and the outer peripheral side surface at the base portion of the nozzle body disposed so as to be slidable in forward and backward directions is screwed with the base portion of the outermost cylinder portion forming the outer flow path, thereby allowing the nozzle body to move in forward and backward directions by the rotation of the outermost cylinder portion.

The present invention further provides the sprinkler nozzle characterized in that the inner cylinder comprises an inside inner cylinder having the inner flow path as a water flow space disposed on the outer peripheral side of the nozzle body and an outside inner cylinder having an intermediate flow path as a water flow space disposed on the outer peripheral side of the inside inner cylinder, in which the intermediate flow path is disposed so as to communicate with the through hole of the nozzle body and with a communicating path disposed in the intermediate flow path by the forward or backward movement of the nozzle body and the outer flow path is disposed so as to communicate with the through hole of the nozzle body and with a communicating path disposed in the outer flow path by the forward or backward movement of the nozzle body, whereby water can be caused to flow selectively through the intermediate flow path and the outer flow path and the intermediate flow path is disposed at a rear end thereof so as to communicate with the first sprinkling outlet of the sprinkling plate disposed at the tip end of the outside inner cylinder.

Moreover, the present invention provides the sprinkler nozzle characterized in that the first sprinkling outlet comprises a plurality of sprinkling small holes disposed radially from a center of the sprinkling plate toward an outer periphery thereof and the second sprinkling outlet is disposed at a peripheral edge portion of the sprinkling plate.

In accordance with the present invention, the sprinkler nozzle further provides the sprinkler nozzle characterized in that the first sprinkling outlet comprises a plurality of holes in a fan-shaped form disposed in a position symmetrical from a center of the sprinkling plate so as to sprinkle water in a fan-shaped form and the second sprinkling outlet comprises a number of sprinkling small holes disposed over an approximately entire area of the sprinkling plate.

The sprinkler nozzle according to the present invention is further characterized in that the inner cylinder is divided into a front-stage inner cylinder and a rear-stage inner cylinder.

The sprinkler nozzle according to the present invention is additionally characterized in that the front-stage inner cylinder is provided on an inner peripheral side surface thereof with ribs at predetermined intervals in a peripheral direction so as to allow the ribs to come into abutment with the first sealing member and so as for a gap between the ribs to form the inner flow path, and the rear-stage inner cylinder is provided on an opening edge portion at a tip end thereof with concave portions so as to engage with the ribs provided on the front-stage inner cylinder in such a manner that the ribs are engaged integrally with the concave portions of the rear-stage inner cylinder upon an integral assembly of the front-stage inner cylinder with the rear-stage inner cylinder so as for the front-stage inner cylinder to be detachable.

BRIEF DESCRIPTION OF THE ACCOMPANYING DRAWINGS

Figure 2:
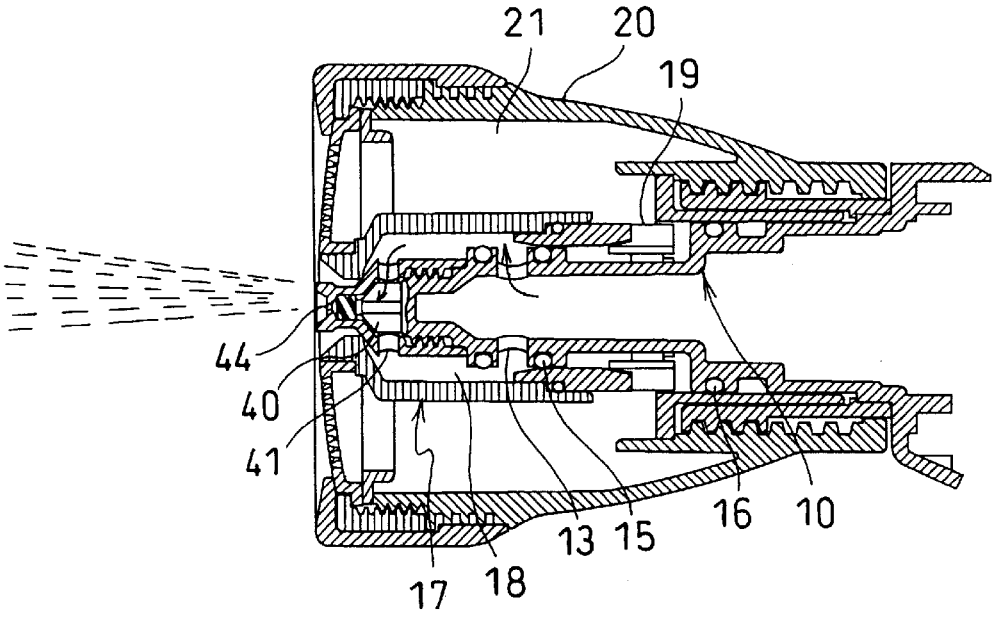
Figure 3:
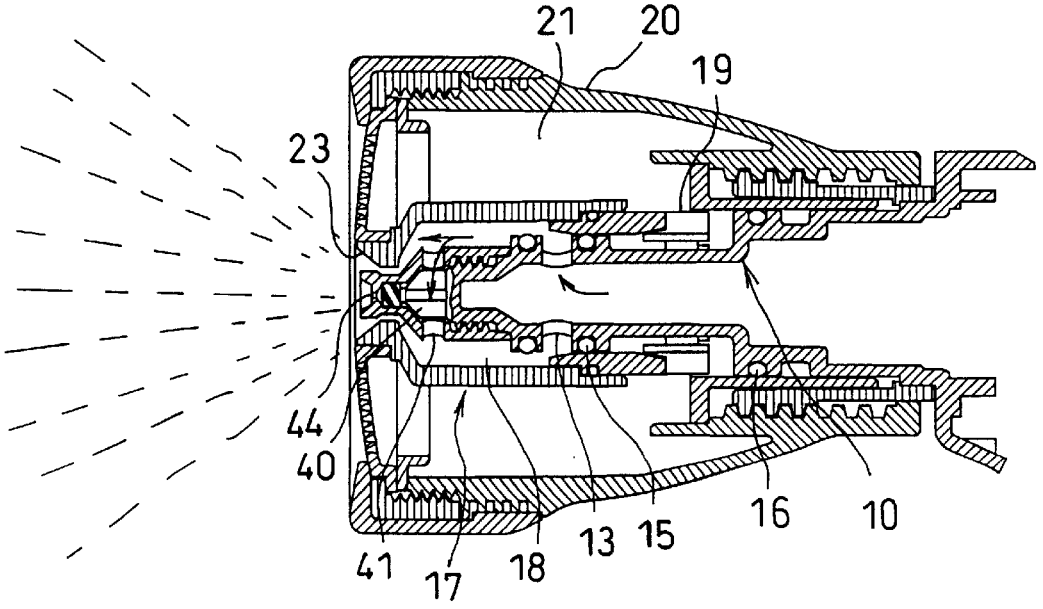
Figure 4:
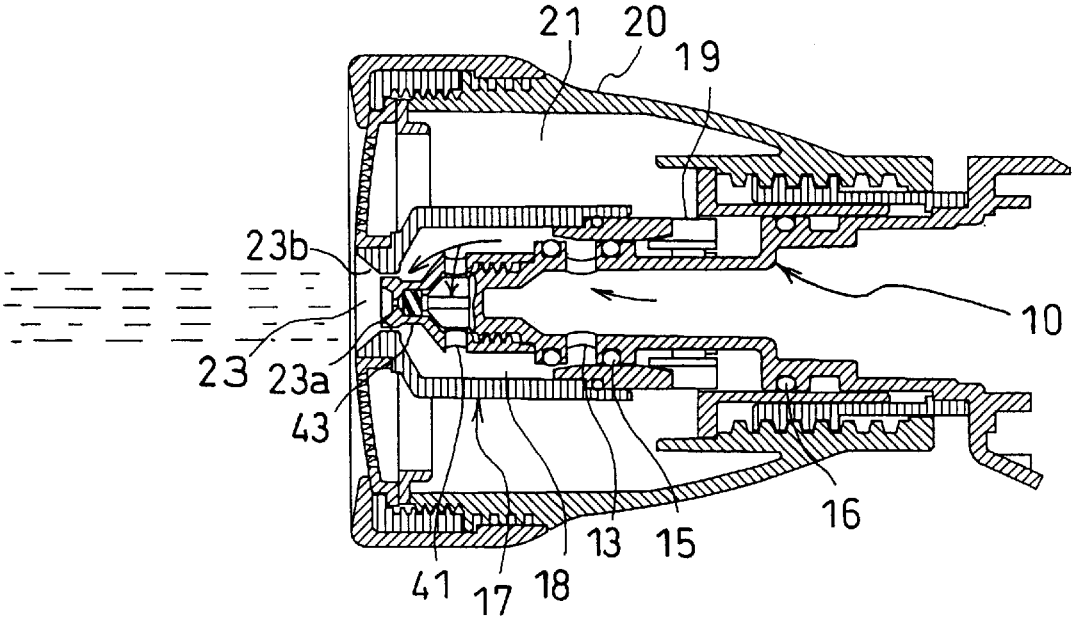
Figure 5:
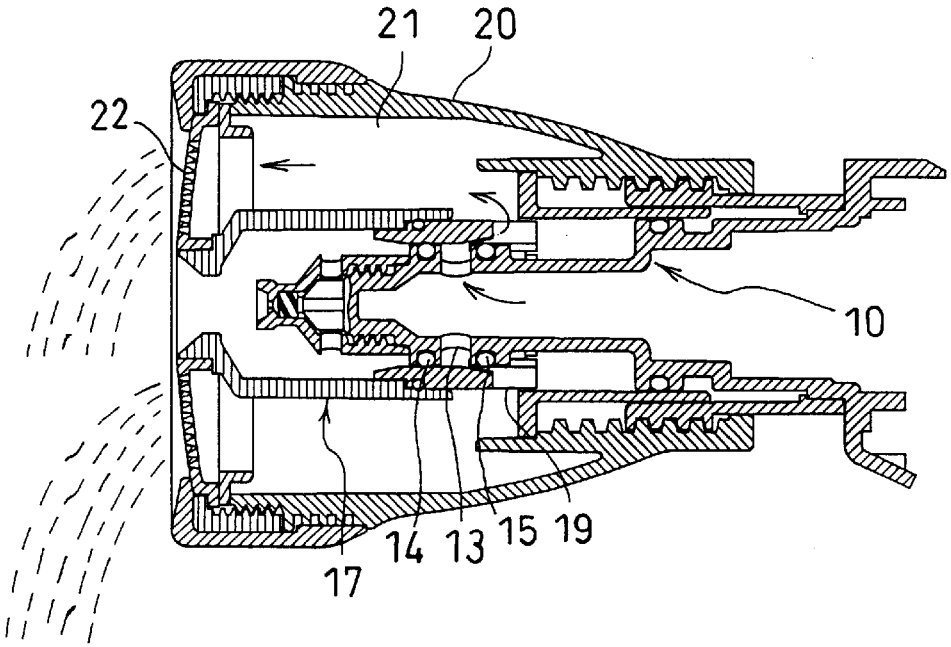
Figure 6:
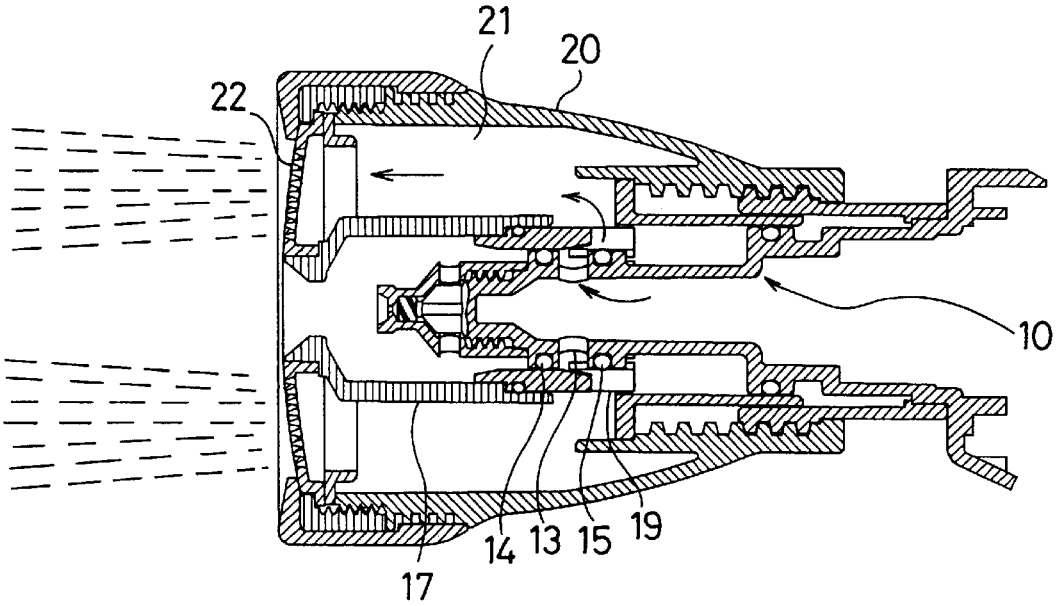
Figure 7:
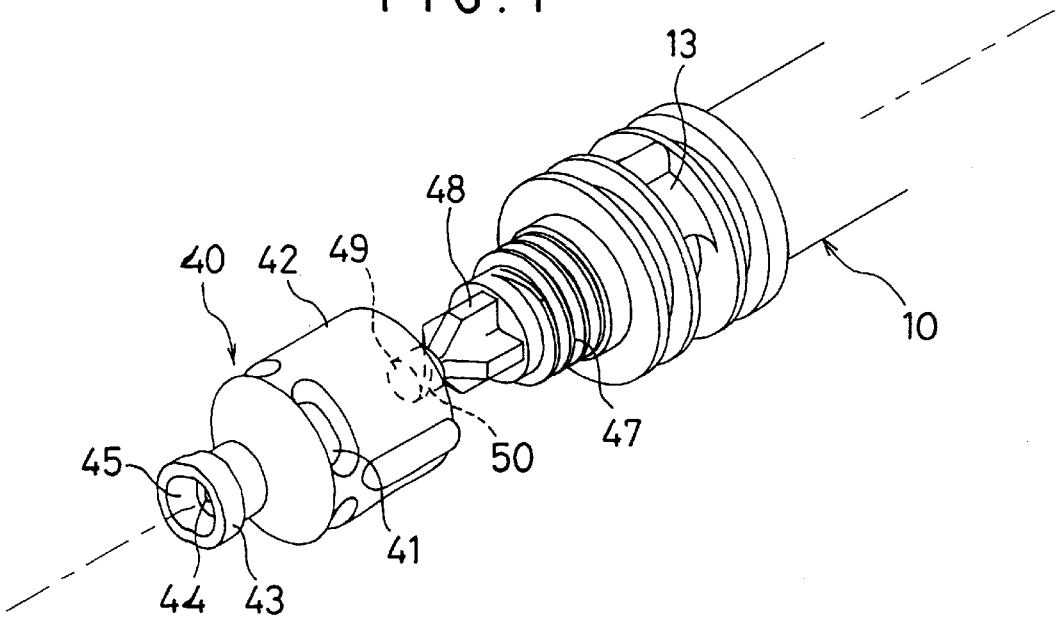
Figure 8:
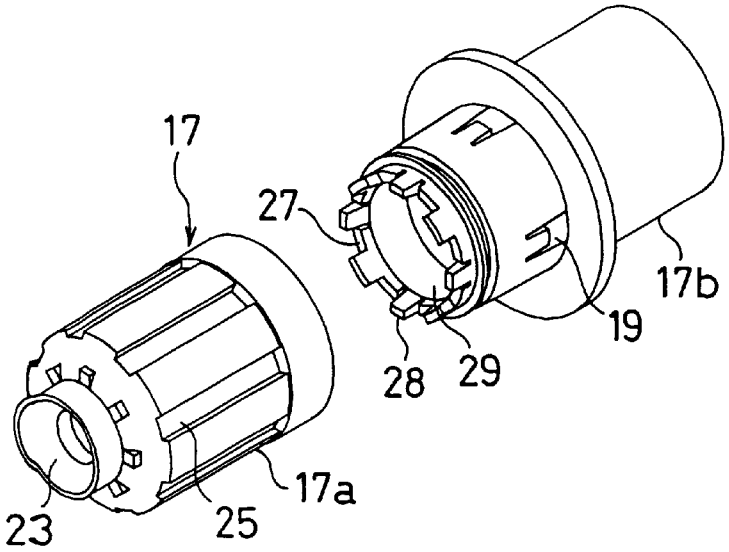
Figure 9:
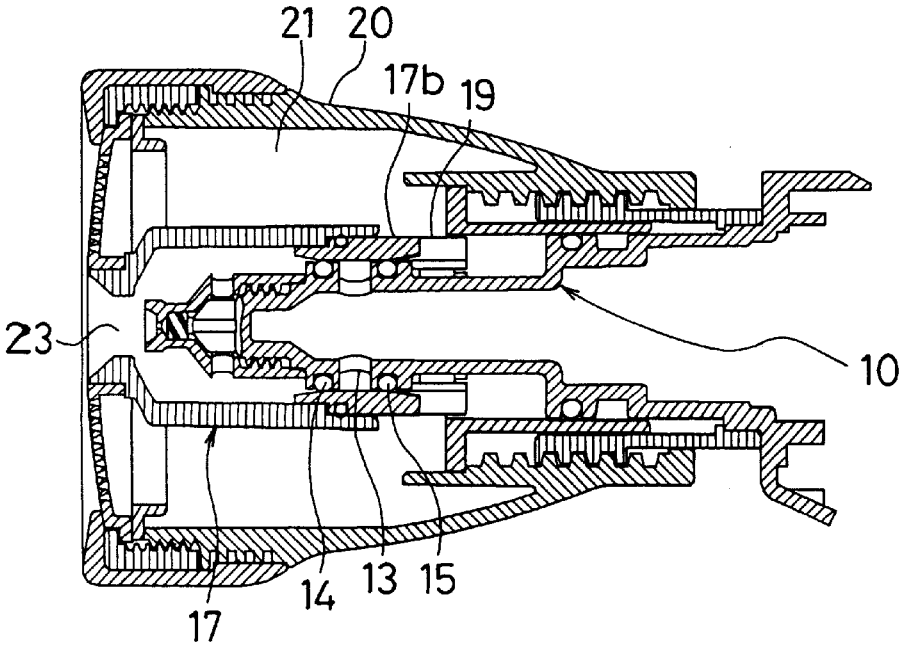
Figure 10:
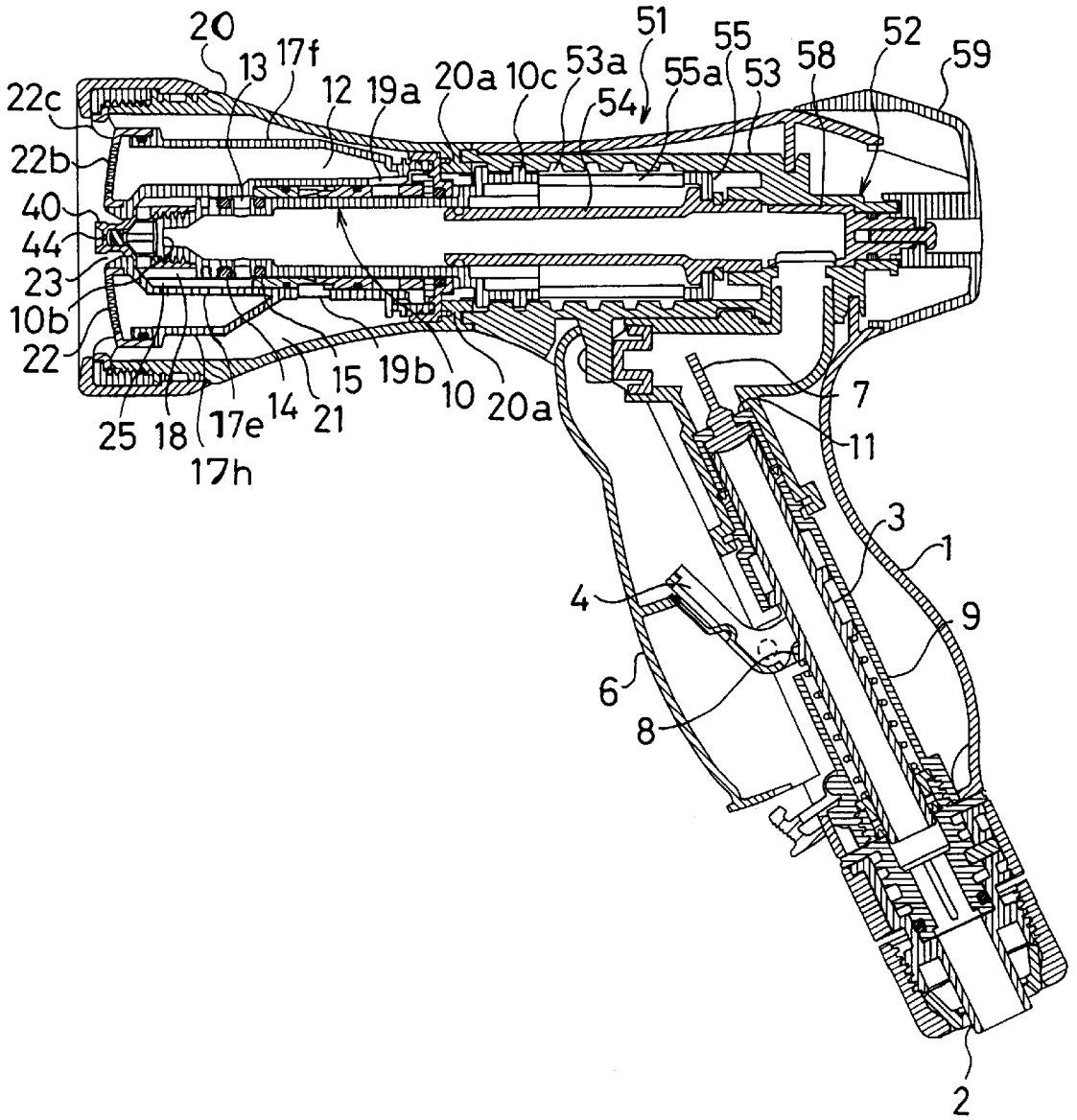
Figure 11:
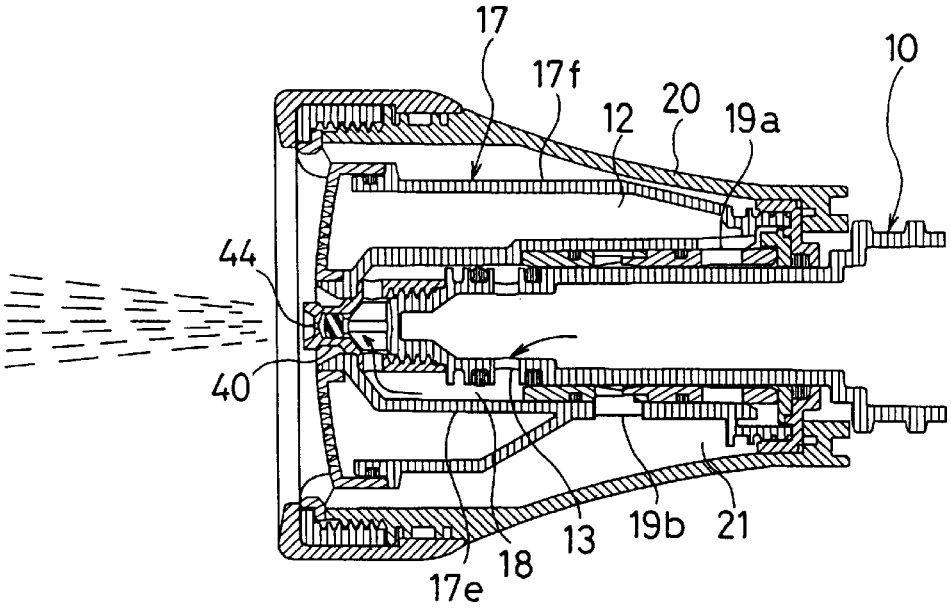
Figure 12:
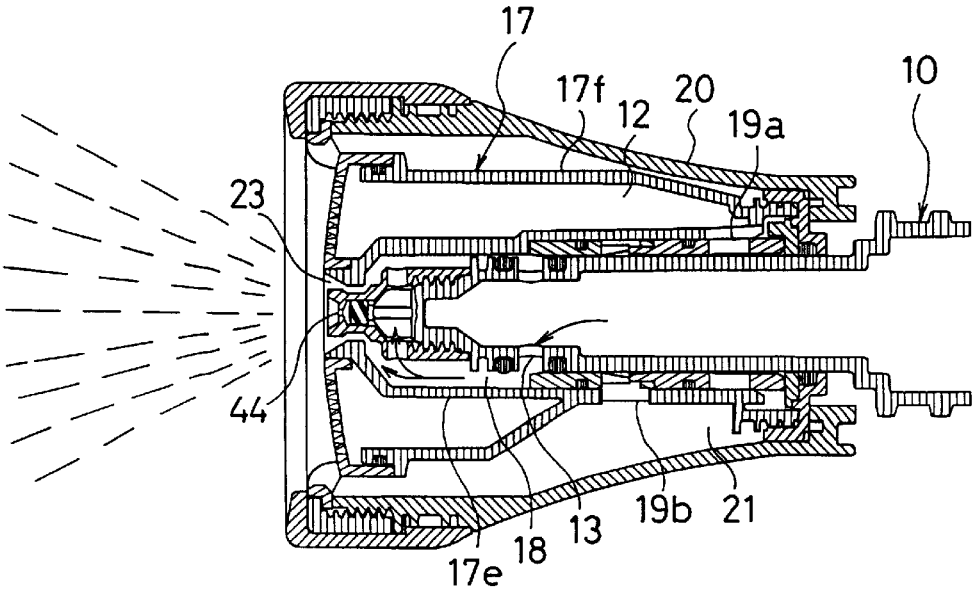
Figure 13:
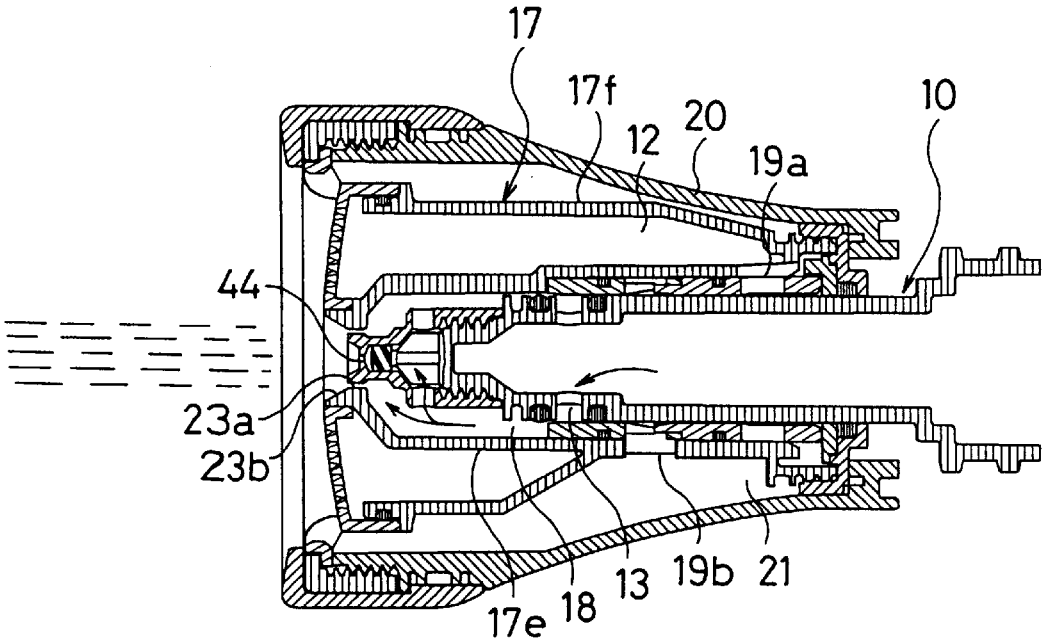
Figure 14:
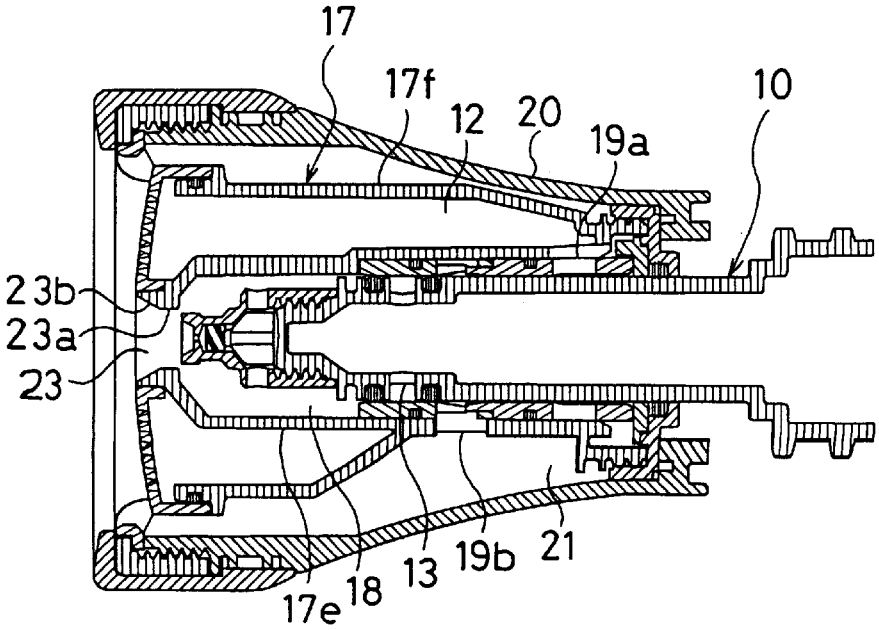
Figure 15:
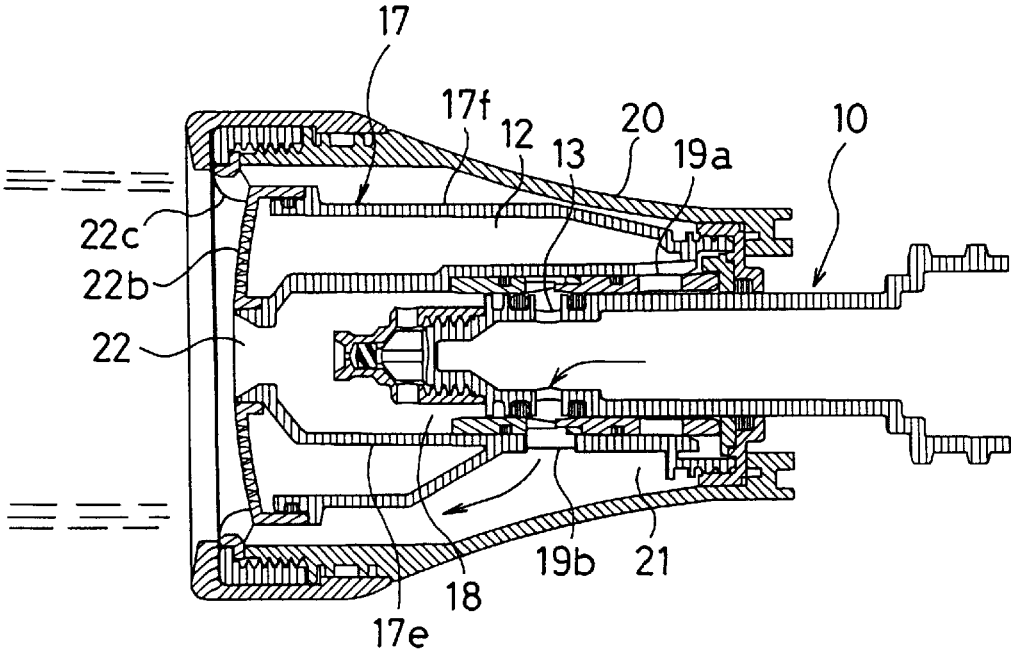
Figure 16:
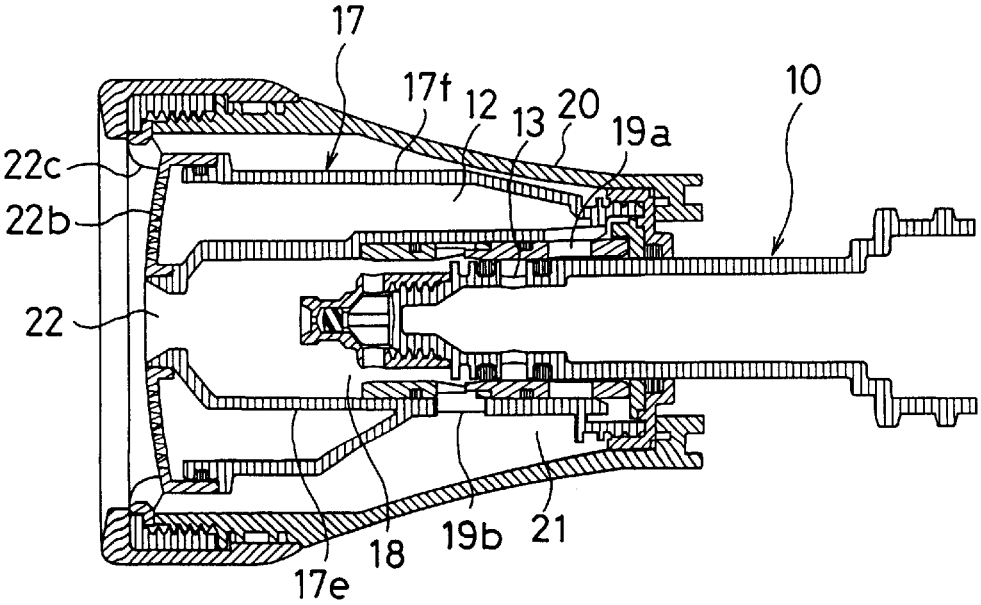
Figure 17:
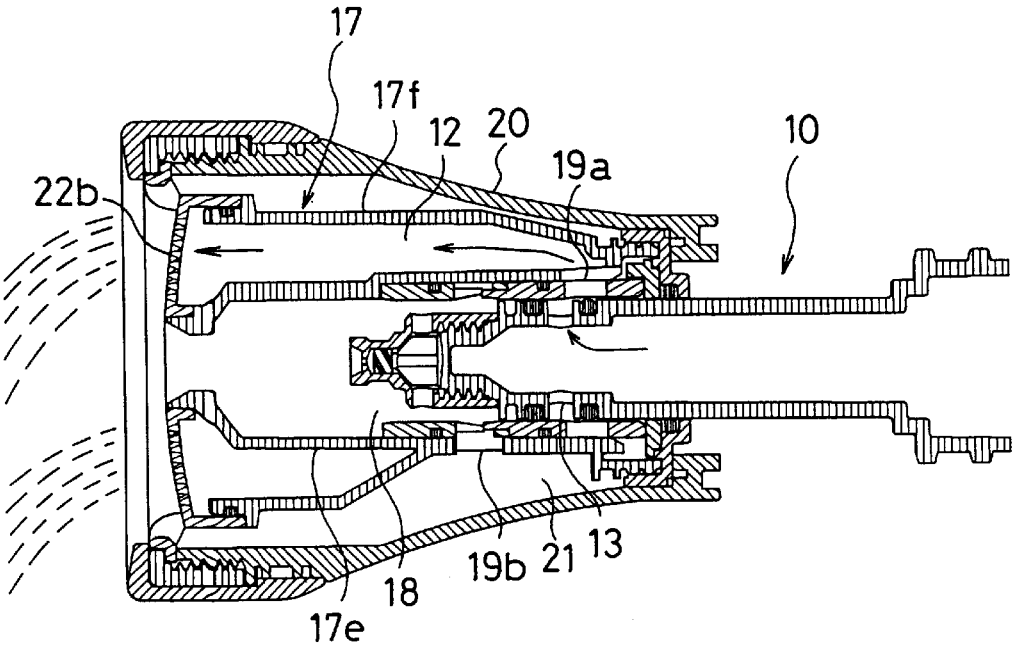
Figure 18:
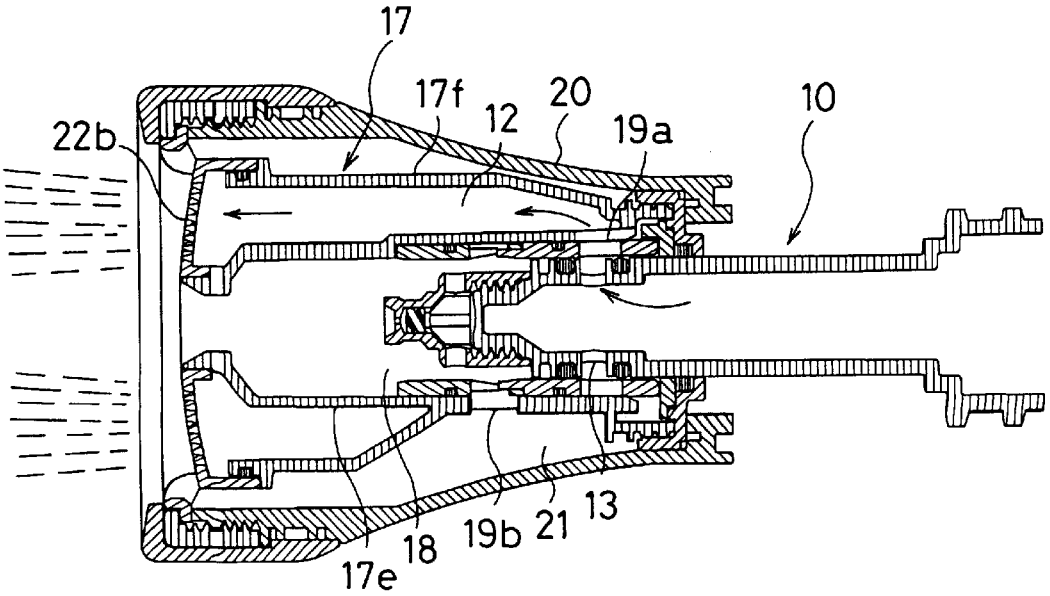
Figure 19:
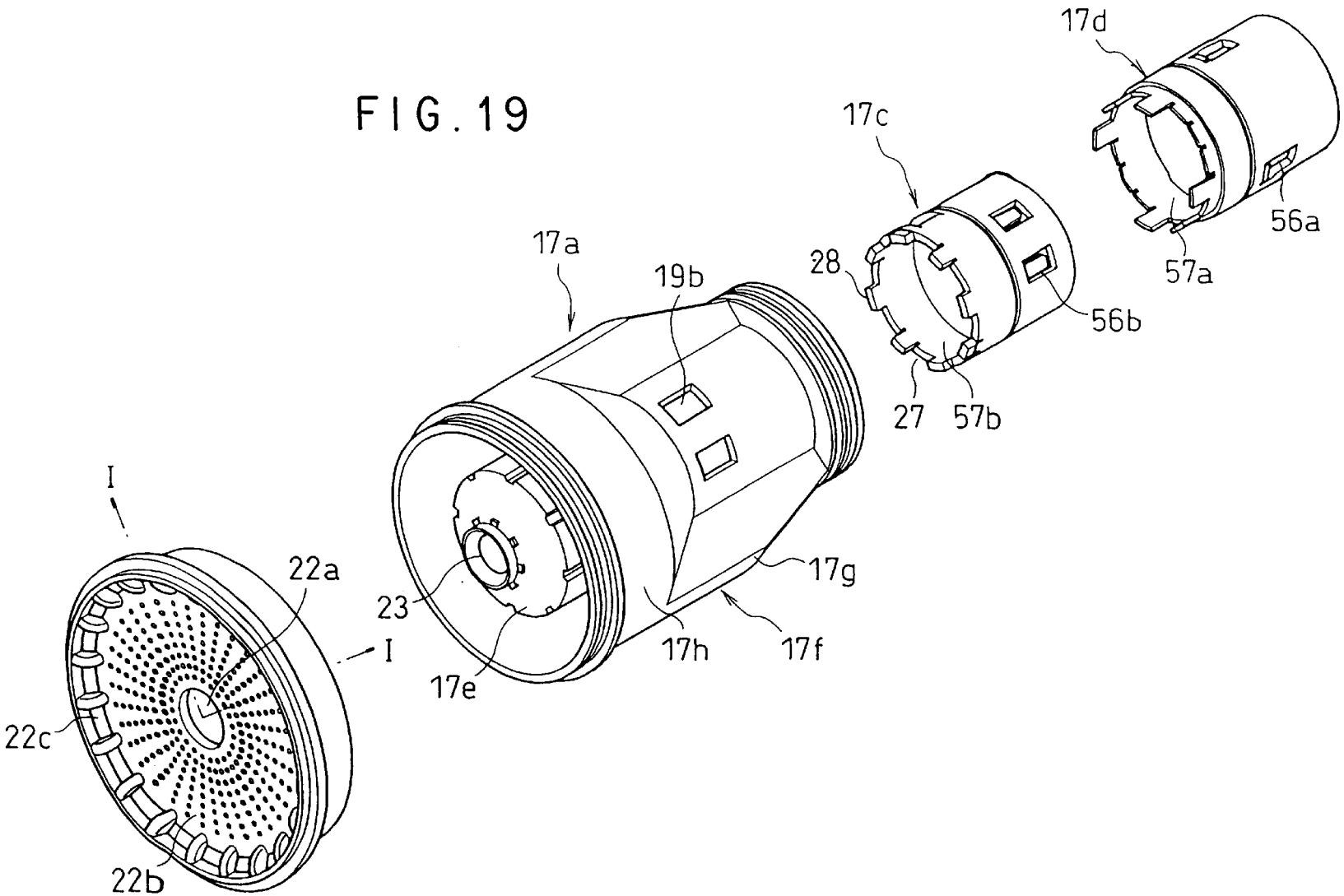
Figure 20:
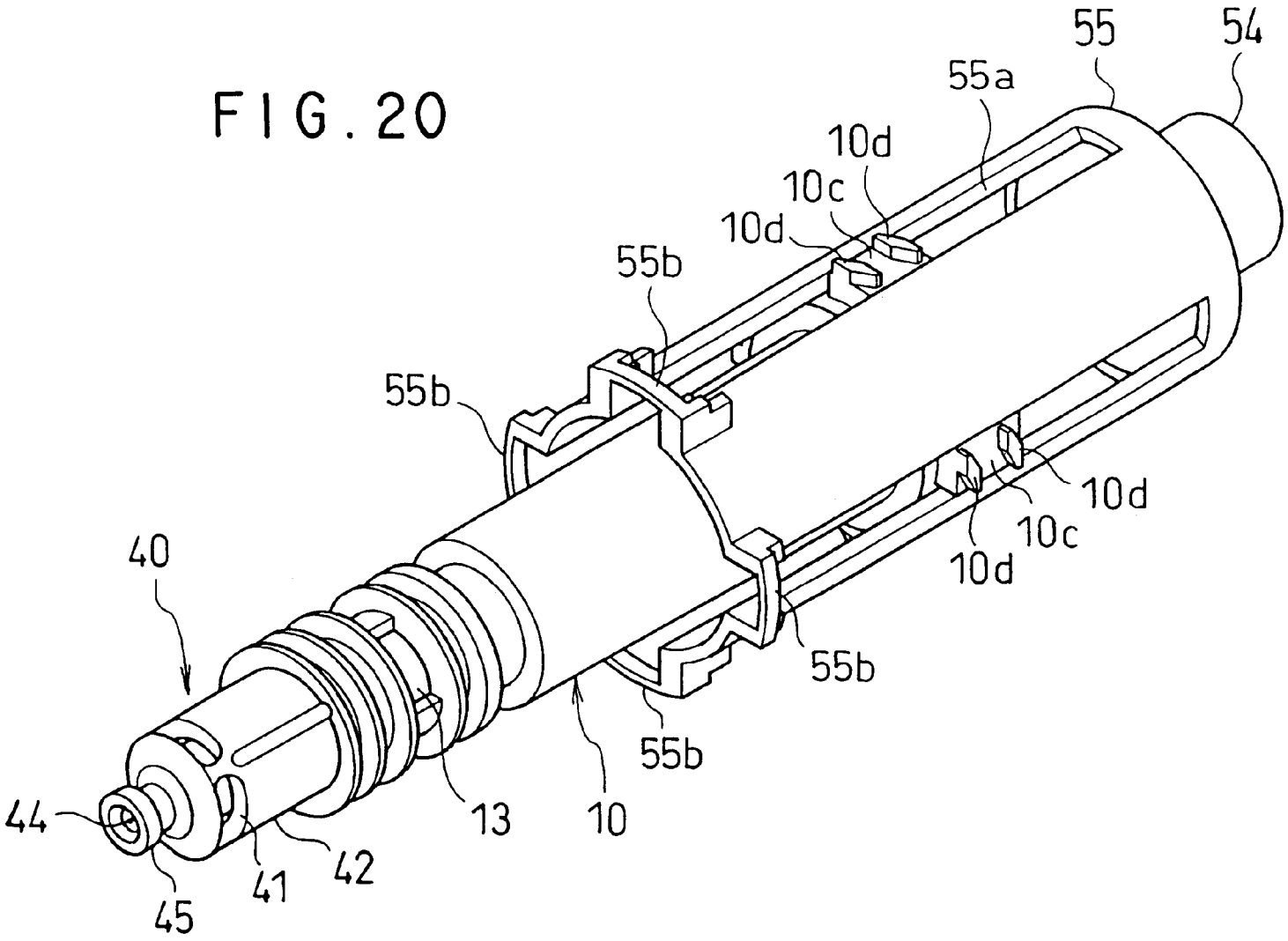
Figure 21:
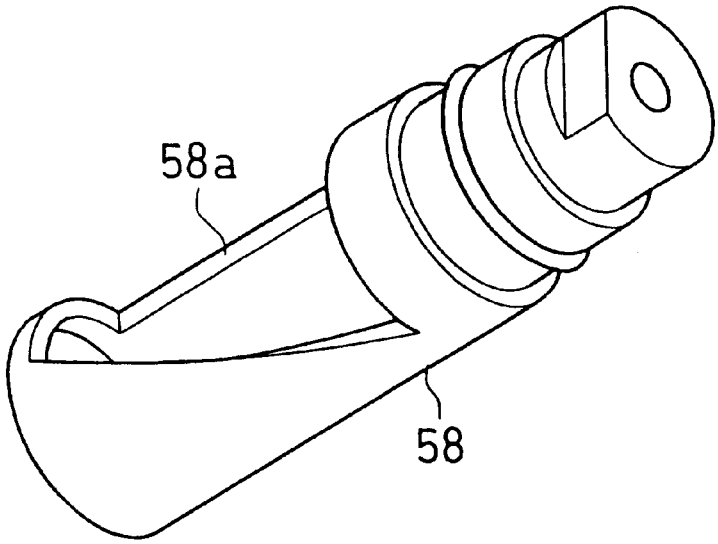
Figure 22:
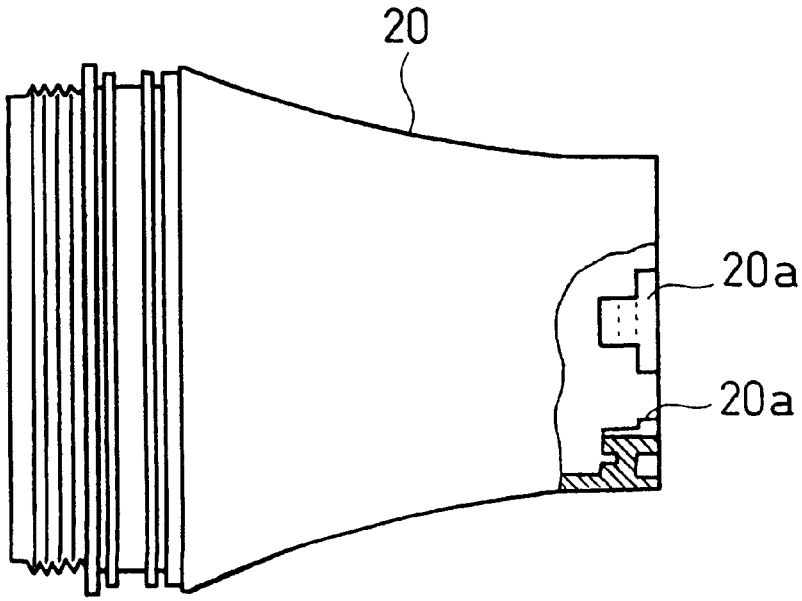
Figure 23:
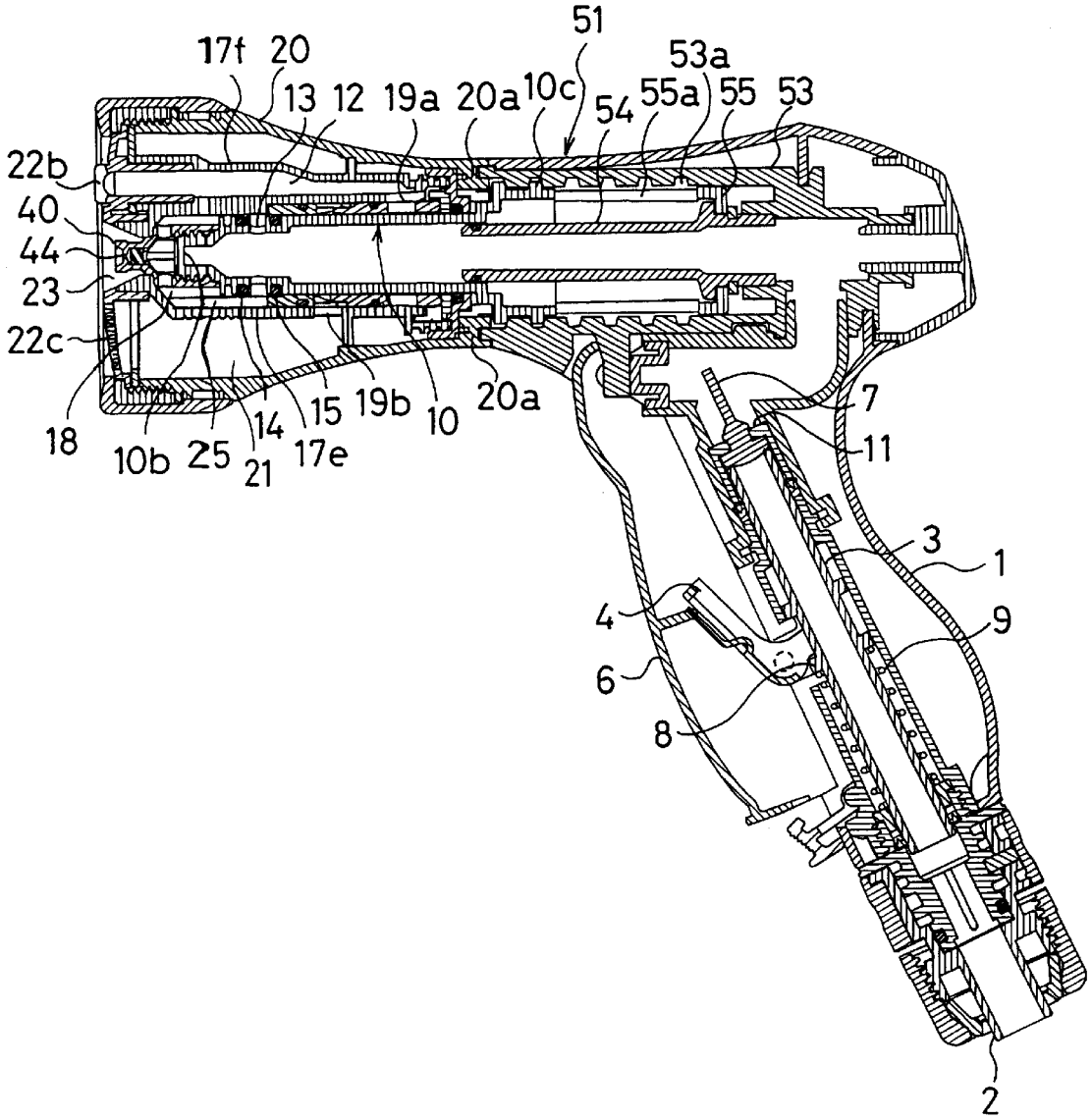
Figure 24:
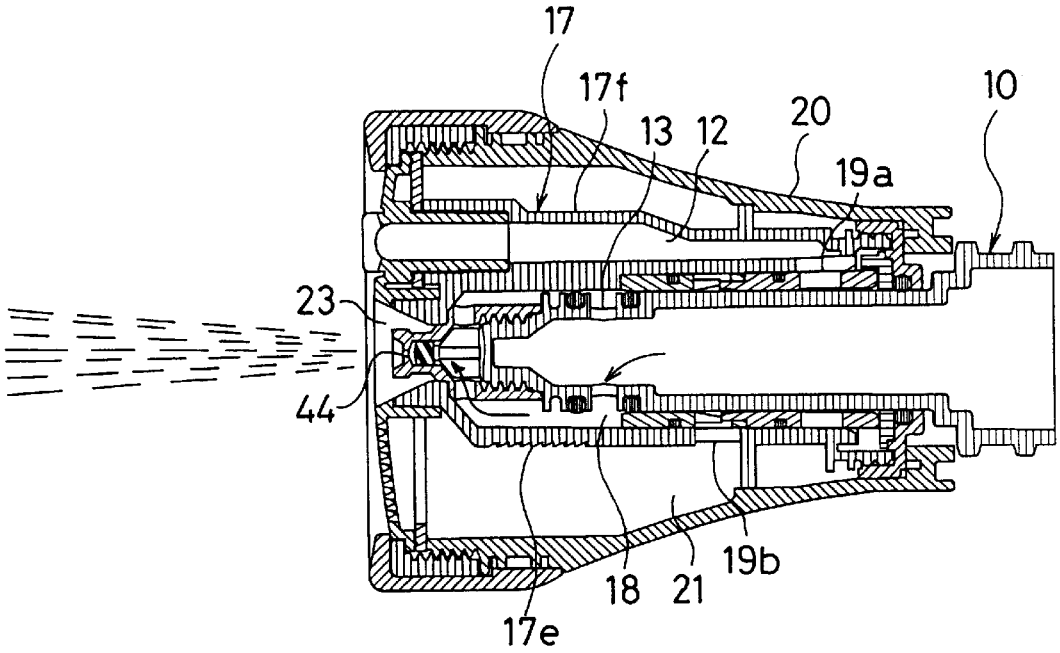
Figure 25:
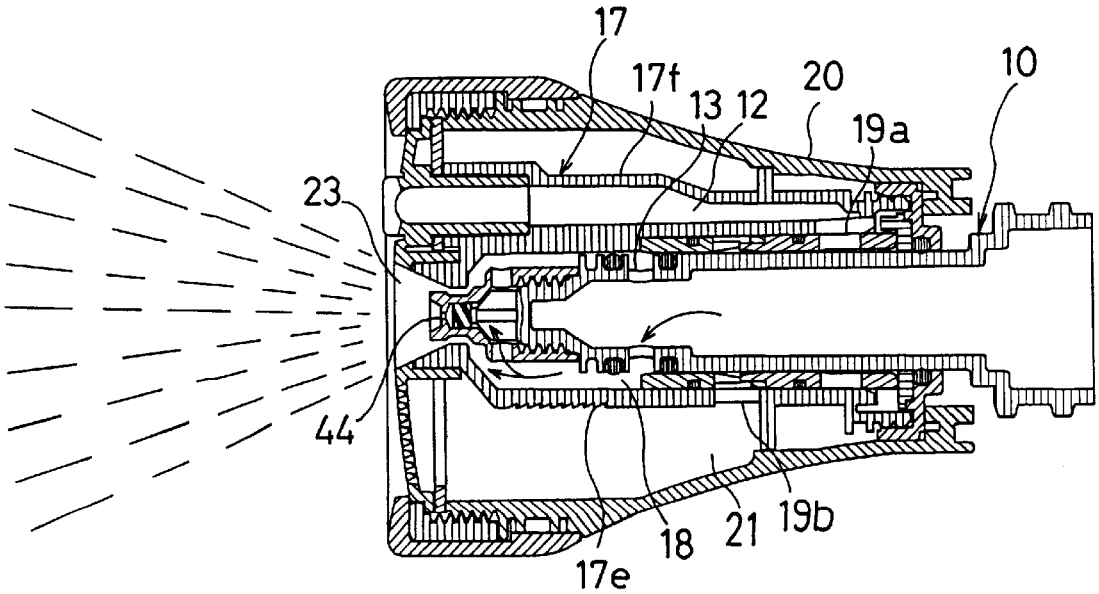
Figure 26:
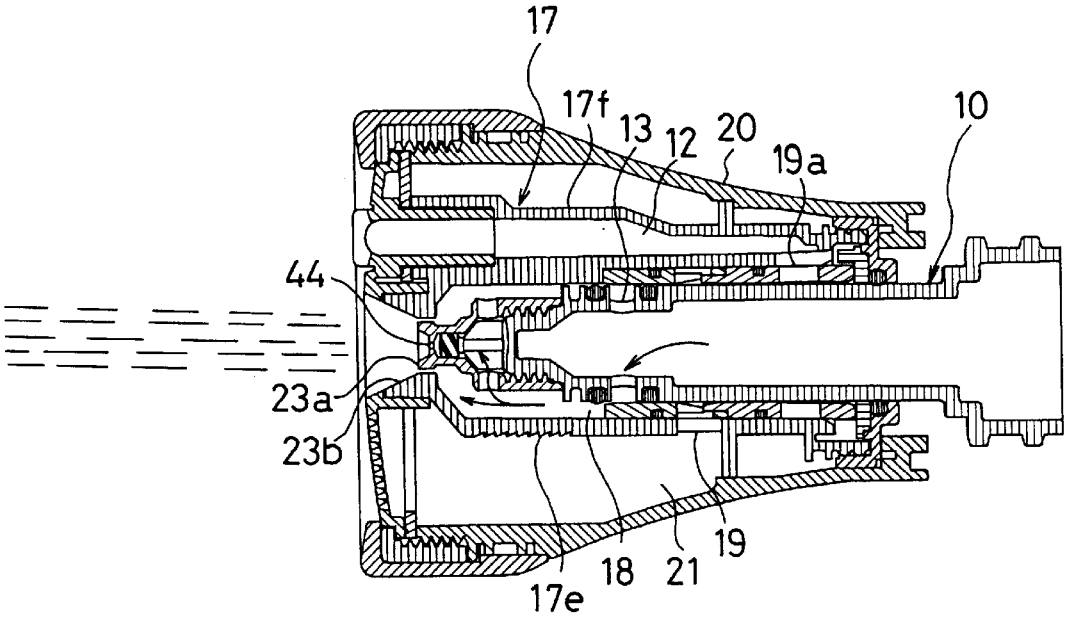
Figure 27:
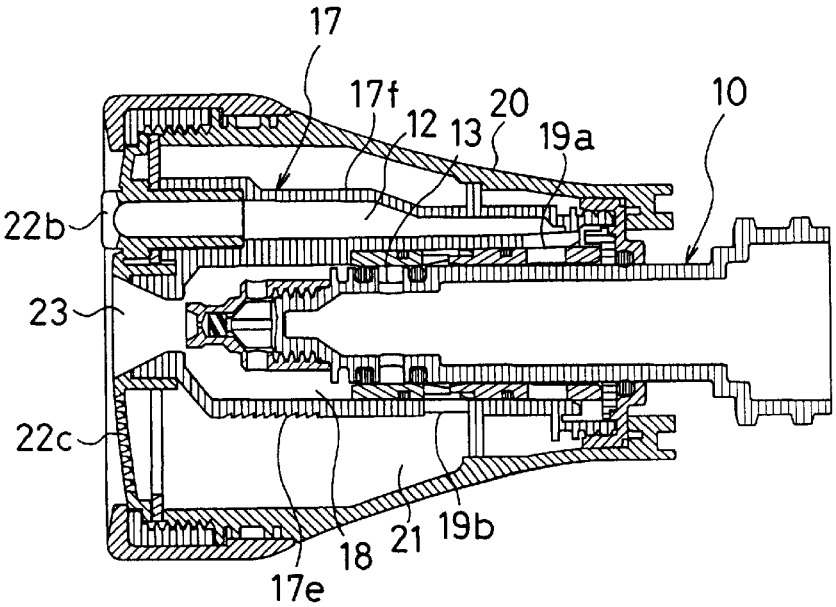
Figure 28:
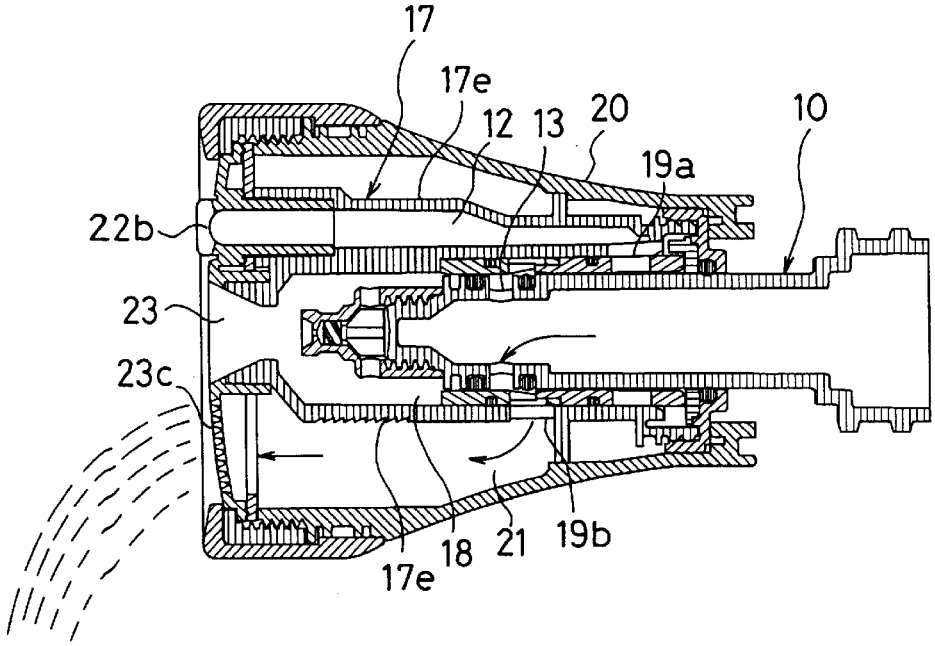
Figure 29:
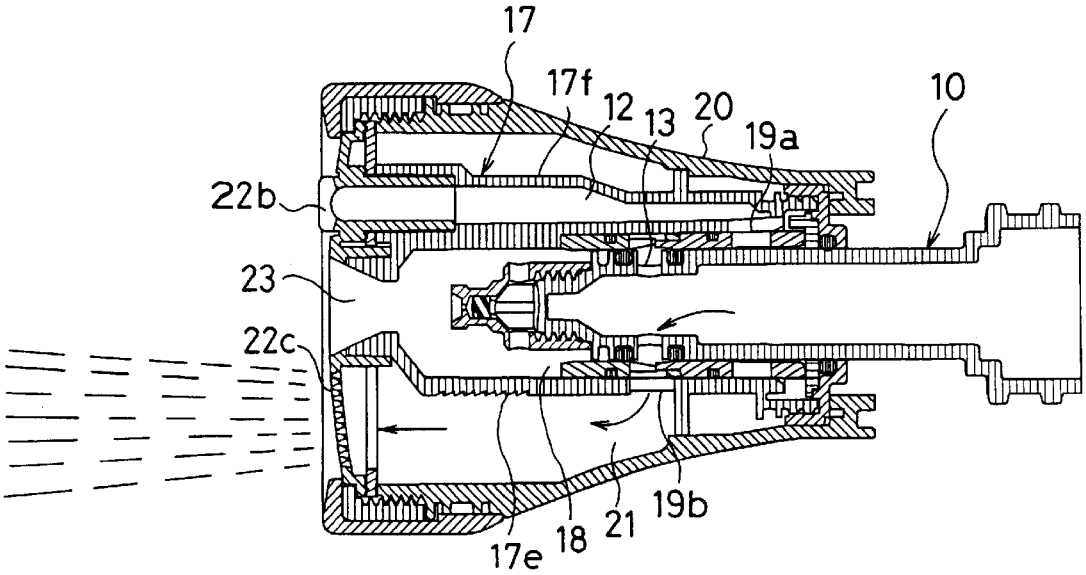
Figure 30:
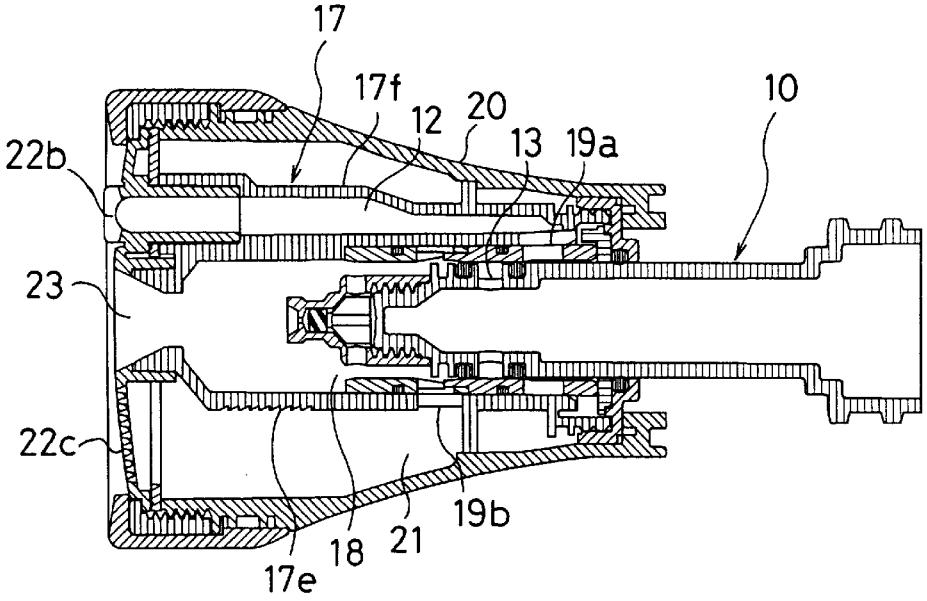
Figure 31:
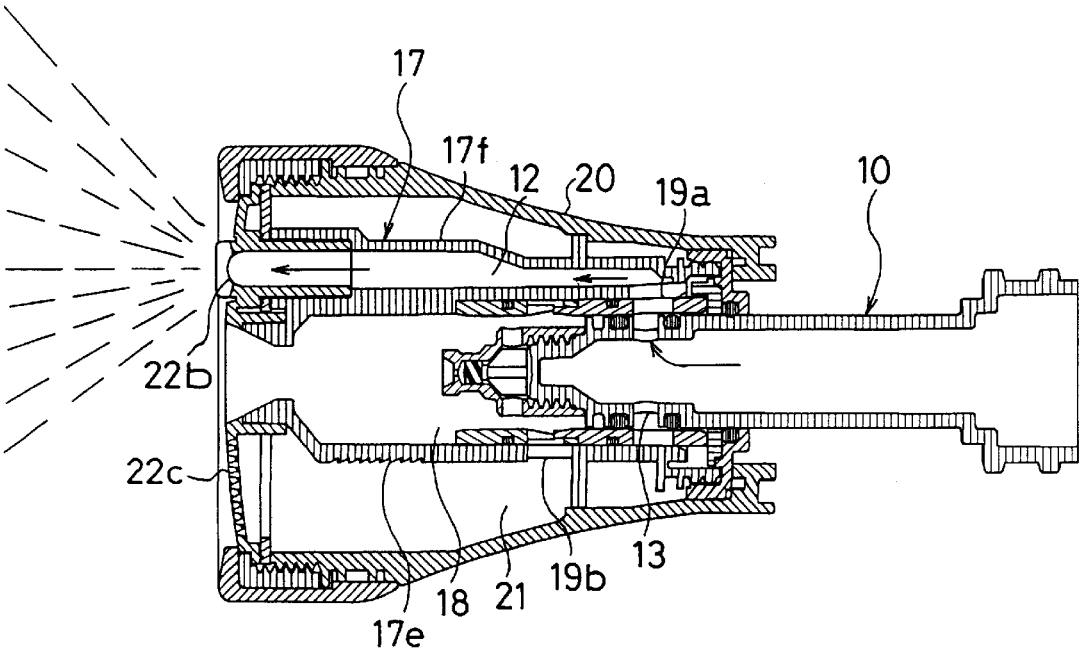

FIG. 1 is a view showing a section of a sprinkler nozzle according to the present invention; FIG. 2 a view in section showing an essential part for sprinkling water in a sprinkling pattern in a mist form; FIG. 3 a view in section showing an essential part for sprinkling water in a sprinkling pattern in a cone-shaped form; FIG. 4 a view in section showing an essential part for sprinkling water in a sprinkling pattern in a straight rod form; FIG. 5 a view in section showing an essential part for sprinkling water in a sprinkling pattern in a watering pot-shaped form; FIG. 6 a view in section showing an essential part for sprinkling water in a sprinkling pattern in a shower form; FIG. 7 an exploded, perspective view showing the nozzle head portion; FIG. 8 an exploded, perspective view showing the inner cylinder; FIG. 9 a view showing a section of an essential portion when the sprinkling of water is stopped; FIG. 10 a view in section showing a sprinkler nozzle according to the second embodiment of the present invention; FIG. 11 a view in section showing an essential part for sprinkling water in a sprinkling pattern in a mist form; FIG. 12 a view in section showing an essential part for sprinkling water in a sprinkling pattern in a cone-shaped form; FIG. 13 a view in section showing an essential part for sprinkling water in a sprinkling pattern in a straight rod form; FIG. 14 a view in section showing an essential part for sprinkling water in a s state where the sprinkling of water is stopped; FIG. 15 a view in section showing an essential part for sprinkling water in a sprinkling pattern in a circular form; FIG. 16 a view in section showing an essential part for sprinkling water in a s state where the sprinkling of water is stopped; FIG. 17 a view in section showing an essential part for sprinkling water in a sprinkling pattern in a watering-pot shaped form; FIG. 18 a view in section showing an essential part for sprinkling water in a sprinkling pattern in a shower form; FIG. 19 an exploded, perspective view showing an inner cylinder; FIG. 20 a perspective view showing a sliding mechanism of the nozzle body; FIG. 21 a perspective view showing a flow amount adjustment cylinder; FIG. 22 a partially cutaway, side view showing the outermost cylinder part; FIG. 23 a view in section showing a sprinkler nozzle according to the third embodiment of the present invention; FIG. 24 a view in section showing an essential part for sprinkling water in a sprinkling pattern in a mist form; FIG. 25 a view in section showing an essential part for sprinkling water in a sprinkling pattern in a cone-shaped form; FIG. 26 a view in section showing an essential part for sprinkling water in a sprinkling pattern in a straight rod form; FIG. 27 a view in section showing an essential part for sprinkling water in a s state where the sprinkling of water is stopped; FIG. 28 a view in section showing an essential part for sprinkling water in a sprinkling pattern in a watering pot-shaped form; FIG. 29 a view in section showing an essential part for sprinkling water in a sprinkling pattern in a shower form; FIG. 30 a view in section showing an essential part for sprinkling water in a state where the sprinkling of water is stopped; FIG. 31 a view in section showing an essential part for sprinkling water in a sprinkling pattern in a fan-shaped form; and FIG. 32 a view showing a sprinkling plate.

BEST MODES FOR CARRYING OUT THE INVENTION

The present invention will be described more in detail with reference to the accompanying drawings.

FIG. 1 is a sectional view of the sprinkler nozzle according to the present invention, in which reference numeral 1 denotes a holding cylinder having a hose connection part 2 disposed at a bottom end of the holding cylinder and a holding lever 6 disposed at a front side of the holding cylinder 1 through a bracket 5 so as to be pivotally movable. In the holding cylinder 1 are disposed a sliding pipe 3 and a control valve 7, the sliding pipe 6 being inserted so as to slide upwards and downwards and the control valve 7 being disposed so as to abut with a top end of the sliding pipe. An intermediate portion of the sliding pipe 3 is connected to a lever 4 disposed at an intermediate portion of the holding lever 6. At an intermediate portion of the sliding pipe 3, there is disposed a projection part 8 and a spring 9 is disposed between the projection part 8 and an inner bottom end of the holding cylinder 1, thereby causing the sliding pipe 3 to be in abutment with and to be always biased by the control valve 7 blocking an inflow of water.

Further, the top end of the holding cylinder 1 is disposed so as to communicate with a rear end portion of a nozzle body 10 in a hollow cylinder-shaped form and the rear end portion thereof is formed with a valve receipt portion 11 so as to provide a water inflow gap between the valve receipt portion 11 and the control valve 7. With the arrangement as described hereinabove, when water is supplied from the hose connection part 2 disposed at the bottom end of the holding cylinder 1, the water passes through the sliding pipe 3 in the holding cylinder 1 and blocked by the control valve 7. Therefore, when the sliding pipe 3 is depressed to a lower position in resistance to the biasing of the spring 9, the top end of the sliding pipe 3 closed by the control valve 7 is caused to open thereby allowing the water to flow into the nozzle body 10 through a communicating hole formed between the control valve 7 and the valve receipt portion 11 disposed at a rear end of the nozzle body 10.

The nozzle body 10 is disposed in such a manner that its tip end is closed and a nozzle head portion 40 in a cylindrical shape with its tip end converged is screwed in a portion ahead of a closed portion 10*b* and a peripheral wall of the nozzle head portion 40 is provided with four inflow holes 41 communicating with an inner flow path 18 as will be described hereinafter.

The structure of the nozzle head portion on part 40 will be described more in detail with reference to FIG. 7. The nozzle head portion 40 comprises a cylinder-shaped section 42 and a converging nozzle tip end section 43 disposed at the tip end of the cylinder-shaped section 42. At the tip end of the nozzle tip end section 43 is provided a small hole 44 having a tapered surface 45 with its top portion tapered so as to expand.

Further, an inner peripheral surface of the cylinder-shaped section 42 is formed a female screw part so as to screw with a male screw part 47 formed on an outer peripheral surface of the closed portion 10*b*. Moreover, on a front end surface of the closed portion 10*b* in the cylinder-shaped section 42, there is formed a partition wall 48 projecting in radial directions so as to provide a water flow path communicating with the inflow holes 41. The partition wall 48 divides and forms the water flow paths within the cylinder-shaped section 42 and has the function of uniformly guiding the water flown from a number of inflow holes 41 to fine hole 44.

On the other hand, the tip end of the partition wall 48 has a projecting member 49 disposed so as to project into the nozzle tip end section 43 in a narrowing shape and it is provided on its peripheral surface with peripheral spiral grooves 50.

The nozzle body 10 is provided with a through hole 13 in the peripheral wall at an intermediate portion and mounted with a first sealing member 14 and a second sealing member 15, each made of a rubbery material, in the positions ahead and behind the through hole 13, respectively, on an outer peripheral side surface of the nozzle body. In the drawing, reference numeral 16 denotes a third sealing member mounted on a rear portion of the nozzle body 10.

On the outer peripheral side surface of the nozzle body 10 is provided an inner cylinder 17 so as to be movable in forward and backward directions while surrounding an inner flow path 18. When the inner cylinder 17 is allowed to move in the forward direction, the inner flow path 18 is structured in such a manner that, when it is allowed to communicate with the through hole 13 of the nozzle body 10, water can be sprinkled from a clearance provided between a half front portion of the nozzle body 10 and a half front portion of the inner cylinder 17, that is, from a clearance provided between a nozzle outlet 23 acting as an opening part of the inner flow path 18 and a nozzle tip end portion 43 of the nozzle head portion 40 connected at the tip end of the nozzle body 10. At the same time, as the inner flow path 18 is allowed to communicate with the through hole 13, as shown in FIG. 4, water can also be flown in the nozzle head portion 40 through the inflow holes 41 positioned nearby the rear end of the inner flow path 18 and sprinkled in a fine rod-shaped form or in a mist state with a narrow width from the fine holes 44 at its tip end, followed by flowing through the partition wall 48 and then passing through the spiral groove 50.

Further, the inner cylinder 17 is provided at its rear portion with a communicating path 19 which in turn communicates with an outer flow path 21 formed between the inner cylinder 17 and an outermost cylinder-shaped portion 20 surrounding the outer peripheral side surface of the inner cylinder 17. Moreover, the outermost cylinder-shaped portion 20 and the inner cylinder 17 are structured so as to be slidable integrally in the forward and backward directions and an inner peripheral side surface on the base end side of the outermost cylinder-shaped portion 20 is screwed in a male screw cylinder 10*a* disposed on an outer peripheral surface at an intermediate section of the nozzle body 10.

Therefore, when the outermost cylinder-shaped portion 20 rotates on the screwed portion, the inner cylinder 17 integrally disposed is allowed to slide in forward and backward directions integrally with the outermost cylinder-shaped portion 20. Further, a tip end portion of the outer flow path 21 formed between the outermost cylinder-shaped portion 20 and the inner cylinder 17 is provided with a sprinkling plate 22 made of a porous plate or the like.

With the arrangement of the sprinkler nozzle in the manner as described hereinabove, water flown in the holding cylinder 1 passes through the through hole 13 of the nozzle body 10 and it is then sprinkled through a nozzle outlet 23 communicating with the inner flow path 18 primarily depending upon the position of the inner cylinder 17 which is moved forward or backward. The relationship in respect of the relative positions between the nozzle outlet 23 and nozzle head portion 40 can be adjusted to create a sprinkling pattern in a mist state, in a conical shape or in a rod shape, as shown in FIGS. 2 to 4.

Further, at this time, water is also sprinkled from a fine hole 44 of the nozzle head portion 40 toward a central portion of the sprinkling water in a rod shape or the like. Therefore, at the time when water is sprinkled from the nozzle outlet 23 in a rod-shaped form, a conical form or the like or in a mist state, a sprinkling water in a fine rod form or the like from the fine hole 44 is contained in its central portion, thereby preventing the central portion from becoming hollow upon sprinkling in a mist state and extending the sprinkling distance while attracting the water sprinkling nearby a surrounding area.

On the other hand, an inner peripheral surface of the inner cylinder 17 is formed with a flat surface 23*a* and a tapered surface 23*b*, thereby capable of adjusting an interval between the outer peripheral surface of the nozzle head portion 40 and the nozzle outlet 23 and the closing or opening thereof by the forward or backward movement of the inner cylinder 17.

Secondarily, as the inner cylinder 17 moves in a forward direction while operating the pivotal movement of the outermost cylinder-shaped portion 20, the first sealing member 14 and the inner peripheral surface of the inner cylinder 17 are allowed to come into a sealing state, while the second sealing member 15 and the inner peripheral surface of the inner cylinder 17 are allowed to come into an unsealed state, thereby communicating the through hole 13 of the nozzle body 10 with the communicating path 19 of the inner cylinder 17 and allowing the water to pass through the outer flow path 21 and to be sprinkled in a shower as shown in FIGS. 5 and 6.

Furthermore, the communicating area in which the communicating path 19 is communicating with the through hole 13 may be varied in accordance with the distance in which the inner cylinder 17 moves in the forward direction. When the communicating area is small as shown in FIG. 5, water is sprinkled in a funnel-shaped form. On the other hand, when the communicating area is large as shown in FIG. 6, water is sprinkled in a shower form.

Moreover, as shown in FIG. 9, the sprinkling of water can be stopped when the through hole 13 is closed completely by allowing the outer peripheral surface of a rear-stage inner cylinder 17*b* as well as the first sealing member 14 and the second sealing member 15 to come into a sealed state by adjusting the inner cylinder 17 in an appropriate position.

The inner cylinder 17 is divided into two sections, i.e. a front section and a rear section, as shown in FIG. 8. The front-stage inner cylinder 17*a* is disposed so as to be detachable and the front-stage inner cylinder 17*a* can be detached by removing a cover forming a sprinkling plate 22 disposed at the tip end of the outermost cylinder-shaped portion 20.

Further, in instances where the tip end expansion part 40 of the such sprinkler nozzle causes an incident such as clogging or being damaged, the front-stage inner cylinder 17*a* of the inner cylinder 17 is detached after removing the sprinkling plate 22, thereby exposing the tip end expansion part 40 to the outside and enabling a maintenance in a ready predetermined fashion.

The front-stage inner cylinder 17*a* is disposed so as to surround mainly the outer peripheral side surface at the front portion of the nozzle body 10 and the tip end thereof is disposed so as to converge into the nozzle outlet 23 in a small size and the nozzle head portion 40 of the nozzle body 10 is allowed to insert through the nozzle outlet 23 so as to be slidable therein.

Between the front portion of the nozzle body 10 and the front-stage inner cylinder 17*a* thereof is formed a clearance, that is, the inner flow path 18, having a predetermined distance, as shown in FIG. 1. More specifically, the inner peripheral side surface of the front-stage inner cylinder 17*a* is provided with a large number of small-sized ribs 25 side by side at predetermined intervals and a long elongated groove for a water stream is provided between the rib 25 and the rib 25, thereby enabling the formation of a gap for allowing water to flow through the long elongated groove provided between the first sealing member 14 and each rib 25 even if the first sealing member 14 is in abutment with the inner peripheral side surface of the rib 25 of the front-stage inner cylinder 17*a* and as a consequence allowing this gap to constitute the inner flow path 18. In other words, even if the first sealing member 14 comes into a state in which it is fastened with the inner peripheral side surface of the rib 25 in a pressurized state, the water is allowed to pass through the gap between the ribs 25. Furthermore, the provision of the rib 25 can reduce a resistance to abrasion with the first sealing member 14 to a lower level, thereby allowing a smooth sliding movement of the sealing member disposed on the outer peripheral side surface of the nozzle body 10 and preventing the sealing member from being abraded, peeled off or the like.

An opening edge portion at the tip end of rear-stage inner cylinder 17*b* is so structured as to be inserted in the inner peripheral side surface of the front-stage inner cylinder 17*a* in a tight abutment manner as shown in FIG. 8 and the opening edge portion at the tip end thereof is provided with concave portions 27 so as to be tightly abuttable with the ribs 25 disposed in the front-stage inner cylinder 17*a*.

Further, an intermediate portion of the rear-stage inner cylinder 17*b* is provided with a communicating path 19 communicating with the through hole 13 of the nozzle body 10 and leading to the outer flow path 21. The communicating path 19 is further provided on the outer peripheral side surface thereof with a flange portion and the flange portion is so structured so as to be connected with the inner peripheral side surface of-the outermost cylinder-shaped portion 20 so as to be slidable in a predetermined way.

Moreover, as shown in FIG. 8, the inner peripheral side surface at the front portion of the rear-stage inner cylinder 17*b* is provided with an expanded sliding portion 28 which in turn implements a shift between the inner flow path 18 and the communicating path 19 by allowing the first sealing member 14 and the second sealing member 15 of the nozzle body 10 to slide thereon under pressurized conditions.

An inner peripheral surface of a projection piece 28 formed by each concave portion 27 at the tip end opening edge portion thereof is formed as an inclining surface inclining over the entire length of the tip end opening edge portion thereof and the such inclining surface is so formed as to incline at an ingredient expanding gradually towards its tip end.

This is so structured as to allow the sealing surface of the nozzle body 10 to readily move in the forward and backward directions in and from the inside of the rear-stage inner cylinder 17*b* in a smooth fashion at the time when the first sealing member 14 and the second sealing member 15 of the nozzle body 10 move sliding with the inner peripheral side surface of the inner cylinder 17.

Further, the surface extending to the communicating path 19 from the sliding portion 29 on the inner peripheral side surface of the rear-stage inner cylinder 17*b* is also formed as an inclining surface and the inclining surface is formed so as to incline at an angle expanding gradually toward the communicating path 19, thereby contributing to the smoothly forward and backward movement of the nozzle body 10 and a smooth variation in a flow amount in a manner equal to the inclining surface as described hereinabove.

FIGS. 10 to 22 are views showing the sprinkler nozzle in a second embodiment of the present invention, in which FIGS. 10 to 18 are views each showing a tip end portion of the sprinkler nozzle in section as taken along line I—I of FIG. 19.

FIG. 10 is a sectional view showing the sprinkler nozzle in the second embodiment of the present invention. Likewise in the first embodiment of the present invention, a holding cylinder 1 is provided at its bottom end with a hose connection part 2 and the holding cylinder 1 is connected to its tip end with a rear end portion of a nozzle body 10 so as to communicate therewith. Further, water is allowed to flow in the nozzle body 10 by the pivotal operation of a holding lever 6 disposed at a front surface of the holding cylinder 1.

Furthermore, likewise in the first embodiment of the present invention, the nozzle body 10 is structured such that the tip end thereof is closed and that its peripheral wall at the intermediate portion thereof is provided with a through hole 13, while a nozzle head portion 40 as shown in FIG. 10 is screwed at a portion ahead of the closed portion 10*b* and a first sealing member 14 and a second sealing member 15 are mounted in the positions ahead and behind the through hole 13, respectively.

Moreover, between an upper end of the holding cylinder 1 and a rear end portion of the nozzle body 10 is interposed a nozzle body sliding mechanism 51 for sliding the nozzle body and a flow amount adjustment mechanism 52 for adjusting a flow amount.

The nozzle body sliding mechanism 51 is structured in such a manner, as shown in FIGS. 10 and 20, that a base end of a central cylinder 54 in a cylindrical shape is mounted coaxially on a base end of a fixed cylinder 53 in a cylinder shape, a base end of a pivotal cylinder 55 in a cylinder shape is mounted on the base end of the central cylinder 54 so as to move in a pivotal manner, a peripheral wall of the pivotal cylinder 55 is provided with four guide grooves 55*a* at given intervals in a peripheral direction along or parallel to the axis of the pivotal cylinder 55, a male thread part 10*c* formed at the base end of the nozzle body 10 is engaged in the guide groove 55*a* in a freely slidable way, and a male thread 10*d* positioned on the upper surface of the male thread part 10*c* is screwed in a female thread groove 53*a* formed in the inner peripheral side surface of the fixed cylinder 53. With this arrangement, the central cylinder 54 can be accommodated in the pivotal cylinder 55 so as to move in forward and backward directions.

Further, an engageable frame 55*b* projects from the tip end of the pivotal cylinder 55 and the engageable frame 55*b* is provided on its inner peripheral side with four engageable concave portions communicating with the guide groove 55 as. Moreover, as shown in FIG. 22, the inner peripheral side surface at the base end of the outermost cylinder-shaped portion 20 is provided with engageable pieces 20*a* at given intervals in four positions along the peripheral direction. The engagement of each of the engageable pieces 20*a* with each of the corresponding engageable concave portions of the engageable frame 55*b* allows the connection of the tip end of the guide groove 55 to the base end of the outermost cylinder-shaped portion 20 so as to move in association with each other.

The pivotal cylinder 55 is then allowed to move pivotally in association with the pivotal operation of the outermost cylinder-shaped portion 20, thereby allowing the nozzle body 10 to move along the guide groove 55*a* of the pivotal cylinder 55 in forward and backward directions.

As shown in FIG. 10, the inner cylinder 17 holds and surrounds the inner flow path 18 and an intermediate flow path 12 on the outer peripheral side of the nozzle body 10 and the outermost cylinder-shaped portion 20 holds and surrounds the outer flow path 21 on the outer peripheral side of the inner cylinder 17. Further, the sprinkling plate 22 is mounted on the opening portion at the tip ends of the inner cylinder 17 and the outermost cylinder-shaped portion 20 in a covering manner and the nozzle body 10 is so structured as to allow the nozzle body sliding mechanism 51 of the nozzle body to move the inside of the inner cylinder 17 in the forward and backward directions.

The inner cylinder 17 is divided mainly into two sections as shown in FIGS. 10 and 19, in which the rear-stage inner cylinder 17*b* is inserted into the inside of the front-stage inner cylinder 17*a* and the rear-stage inner cylinder 17*b* is further divided into a forward rear-stage inner cylinder 17*c* and a backward rear-stage inner cylinder 17*d*.

Further, in instances where the tip end expansion part 40 of the such sprinkler nozzle causes an incident such as clogging or being damaged, the inner cylinder 17 is detached after removing the sprinkling plate 22, thereby exposing the nozzle head portion 40 to the outside and enabling a ready maintenance in a predetermined fashion.

The front-stage inner cylinder 17*a* comprises an inside inner cylinder 17*e* and an outside inner cylinder 17*f*, the inside inner cylinder 17*e* surrounding the outer peripheral side of the front half portion of the nozzle body 10 and holding the inner flow path 18 therein and the outside inner cylinder 17*f* surrounding the outer peripheral side of the inside inner cylinder 17*e* and holding the intermediate flow path 12 therebetween.

The inside inner cylinder 17*e* is so structured as to primarily surround the outer peripheral side of the front half portion of the nozzle body 10 and the tip end thereof is so structured as to converge into the nozzle outlet 23 of a small size, into which the nozzle head portion 40 of the nozzle body 10 is inserted so as to be slidable therethrough.

As shown in FIG. 10, a predetermined clearance, i.e. the inner flow path 18, is provided at a portion extending between the inside inner cylinder 17*e* and the front half portion of the nozzle body 10. More specifically, the inner peripheral side surface of the inside inner cylinder 17*e* is provided with a number of ribs 25 each of a small size side by side at predetermined intervals and a long elongated groove for flowing a water stream is provided between each pair of the rib 25 and the adjacent rib 25. With this arrangement, a gap is remained open so as to allow the water to flow between the first sealing member 14 and each of the long elongated grooves provided between the ribs 25, even if the first sealing member 14 comes into abutment with the inner peripheral side surface of the rib 25 of the inside inner cylinder 17*e*. In other words, this gap acts as the inner flow path 18. More specifically, even if the first sealing member 14 is in a tightly attached state together with the inner peripheral side surfaces of the ribs 25, water can be allowed to flow through the gaps between the ribs 25. Further, the disposition of the ribs 25 can reduce a resistance to friction with the first sealing member 14 to a lower level, thereby allowing a smooth sliding movement of the sealing members disposed on the outer peripheral side surface of the nozzle body 10 and enabling a prevention of abrasion, separation etc. of the sealing members.

The inside inner cylinder 17*e* is further provided on its outside periphery with the outside inner cylinder 17*f* with retaining a space therein acting as part of the intermediate flow path 12 and the base end of the outside inner cylinder 17*f* is fixed to the outer periphery of the inside inner cylinder 17*e* in a gradually converging shape.

Furthermore, a rear wall 17*g* of the outside inner cylinder 17*f* is so structured as to incline backward, and the inclining rear wall 17*g* is disposed integrally with a communicating hollow wall 17*h*. An opening portion at the hollow rear end of the communicating hollow wall 17*h* is disposed to communicate with the space provided between the inside inner cylinder 17*e* and the outside inner cylinder 17*f* and an opening portion at the hollow front end of the communicating hollow wall 17*h* is disposed to communicate with a communicating path 19*a* provided in the peripheral wall of the inside inner cylinder 17*e*.

Therefore, the intermediate flow path 12 is composed of the communicating path 19*a*, the hollow portion of the communicating hollow wall 17*h* and the outer peripheral space of the inside inner cylinder 17*e*.

As shown in FIGS. 10 and 19, the forward rear-stage inner cylinder 17*c* is structured such that the opening edge portion at the tip end thereof is inserted into the inner peripheral side surface of the front-stage inner cylinder 17*a* in a tightly attached manner and further that the opening edge portion at the tip end thereof is provided with a concave portion 27 so as to be engaged with the rib 25 formed on the inner peripheral side surface of the inside inner cylinder 17*e*.

Further, the forward rear-stage inner cylinder 17*c* is provided at its intermediate portion with a communicating path 56*b* which in turn communicates with the through hole 13 of the nozzle body 10 and at the same time leads to the outer flow path 21 communicating with a communicating path 19*b* of the inside inner cylinder 17*e*. An inner peripheral side surface extending between the tip end opening edge portion thereof and the communicating path 56*b* is provided with a slidable portion 57*b* so as to project in a forward direction. The slidable portion 57*b* is so arranged as to implement a shift between the inner flow path 18 and the outer flow path 21 by tightly attaching to the first sealing member 14 and the second sealing member 15 of the nozzle body 10 or separating from them.

Furthermore, the inner peripheral side surface of the projection piece 28 formed by each concave portion 27 of the tip end opening edge portion thereof is formed as an inclining surface inclining at an angle expanding gradually toward the tip end thereof, thereby making the sealing surface of the nozzle body 10 readily to move forwards or backwards in the inside of the forward rear-stage inner cylinder 17*c* in a smooth manner, when the first sealing member 14 and the second sealing member 15 of the nozzle body 10 slides along the inner peripheral side surface of the inner cylinder 17.

Moreover, the surface extending from the slidable portion 57*b* of the inner peripheral side surface of the forward rear-stage inner cylinder 17*c* to the communicating path 56*b* is also formed as an inclining surface inclining at an angle expanding gradually toward the communicating path 56*b*, thereby contributing to a smooth forward and backward movement of the nozzle body 10 and a smooth variation in the flow amount, likewise the inclining surface as described hereinabove.

As shown in FIGS. 10 and 19, the backward rear-stage inner cylinder 17*d* is structured so as for the tip end opening edge portion thereof to be inserted in and engaged tightly with the inner peripheral side surface of the forward rear-stage inner cylinder 17*c*. Further, like the forward rear-stage inner cylinder 17*c*, the backward rear-stage inner cylinder 17*d* is provided at the tip end opening edge portion thereof with a concave portion so as to engage with the rib 25 formed on the inner peripheral side surface of the forward rear-stage inner cylinder 17*c*. Furthermore, the backward rear-stage inner cylinder 17*d* is provided at its intermediate portion with a communicating path 56*a* that in turn communicates with the through hole 13 of the nozzle body 10 and with the communicating path 19*a* of the inside inner cylinder 17*e*, thereby leading to the intermediate flow path 12. Moreover, on the inner peripheral side surface extending between the tip end opening edge portion thereof and the communicating path 56*a* is provided with an expanding slidable portion 57*a* which in turn is so structured as to implement a shift between the intermediate flow path 12 and the outer flow path 21 by the action of tightly engaging with the first sealing member 14 and the second sealing member 15 of the nozzle body 10 or separating therefrom.

Moreover, the surface extending from the expanding slidable portion 57*a* at the inner peripheral side surface of the backward rear-stage inner cylinder 17*d* to the communicating path 56*a* is also formed with an inclining surface inclining at an angle expanding gradually toward the communicating path 56*a*, thereby contributing to a smooth forward and backward movement of the nozzle body 10 and a smooth variation in the flow amount in the manner as described hereinabove.

The sprinkling plate 22 has a porous plate in a disk shape provided with a number of sprinkling small holes radially from its center towards its outer periphery and is provided in a central position of the porous plate with a communicating hole 22*a* communicating with the nozzle outlet 23 formed at the tip end of the inside inner cylinder 17*e*. The porous plate is further provided with outer peripheral holes at the peripheral edge portion thereof. The communicating hole 22*a* is formed communicating with the inner flow path 18 as well as the sprinkling small holes as first sprinkling outlets 22*b* are formed so as to communicate with the intermediate flow path 12 and the sprinkling small holes as second sprinkling outlets 22*c* are formed so as to communicate with the outer flow path 21.

As shown in FIG. 10, the flow amount adjustment mechanism 52 has a flow amount adjustment cylinder 58 disposed in a position between the tip end of the holding cylinder 1 and the central cylinder 54 constituting the nozzle body sliding mechanism 51 of the nozzle body so as to be movable pivotally, and the flow amount adjustment cylinder 58 is provided at the rear end thereof with a flow amount adjustment control 59 and at the peripheral wall thereof with a flow amount adjustment hole 58*a* formed so as to expand gradually toward the outer periphery, as shown in FIG. 21, thereby enabling a communicating area of the holding cylinder 1 and the nozzle body 10 to vary by the pivotal operation of the flow amount adjustment control 59 and therefore adjusting the flow amount of the water flowing in the nozzle body 10 from the holding cylinder 1.

With the arrangement as described hereinabove, water can be sprinkled in a variety of sprinkling patterns as will be described hereinafter by supplying the water to the nozzle body 10 from a tap of city water and moving the nozzle body 10 in the forward and backward directions while effecting the pivotal operation of the outermost cylinder-shaped portion 20.

More specifically, as shown in FIG. 11, water can be flown in the inflow hole 41 through the through hole 13 by causing the outer peripheral side surface of the nozzle head portion 40 to abut with the inner peripheral side surface of the nozzle outlet 23 and closing the rear end of the inner flow path 18 and the water can be sprinkled from the tip end of the nozzle head portion 40 in a form of mist containing straight sprinkled water.

Then, as the nozzle body 10 is allowed to move to some extent in the backward direction, a gap is somewhat caused to be formed between the nozzle outlet 23 and the nozzle head portion 40 and the rear end of the inner flow path 18 is opened to a small extent, as shown in FIG. 12, where the water is sprinkled from the tip end of the tip end expansion part 40 in a mist form containing the water sprinkled in a straight direction.

In this instance, as the water sprinkled in such a mist state contains the water sprinkled in a straight direction at a central portion of the sprinkled water from the tip end of the nozzle head portion 40, the water can be sprinkled in a long distance and the water is prevented from being sprinkled with its central portion remained hollow without sprinkling water.

Thereafter, as the nozzle body 10 is moved further backward and the flat surface 23*a* of the nozzle outlet 23 reaches the position facing the outer periphery at the tip end of the nozzle head portion 40, as shown in FIG. 13, the water is sprinkled in a straight rod-shaped form from the corresponding gap formed in that position.

As the nozzle body 10 is moved furthermore backward, as shown in FIG. 14, the through hole 13 of the nozzle body 10 is caused to be blocked entirely by the outer peripheral surface of the forward rear-stage inner cylinder 17*c* and the sprinkling of the water is stopped.

Then, the nozzle body 10 is further moved in the backward direction, as shown in FIG. 15, the through hole 13 of the nozzle body 10 is allowed to communicate with the outer flow path 21 via the communicating path 19*b*, thereby enabling sprinkling the water in a circular state from the second sprinkling outlets 22*c* (outer peripheral holes) of the sprinkling plate 22.

Thereafter, when the nozzle body 10 can be further moved in the backward direction, as shown in FIG. 16, the through hole 13 of the nozzle body 10 is entirely closed by the outer peripheral surface of the backward rear-stage inner cylinder 17*d* and the sprinkling of the water is again stopped.

As the nozzle body 10 is moved further in the backward direction from this position, as shown in FIG. 17, the through hole 13 of the nozzle body 10 is allowed to communicate with the intermediate flow path 12 via the communicating path 19*a* to reduce a communicating gap, the water is sprinkled from the first sprinkling outlets 22*b* (sprinkling small holes) of the sprinkling plate 22 in such a form as sprinkled from a watering pot.

Then, the nozzle body 10 is allowed to move further in the backward direction and the communicating gap of the through hole 13 and the intermediate flow path 12 is expanded, as shown in FIG. 18, the water can be sprinkled in a shower form from the first sprinkling outlets 22*b* (sprinkling small holes) of the sprinkling plate 22.

Moreover, the variety of the sprinkling patterns as described hereinabove can be selected optionally by moving the nozzle body 10 forwards to an appropriate position once the nozzle body 10 has been moved backward.

Figure 32:
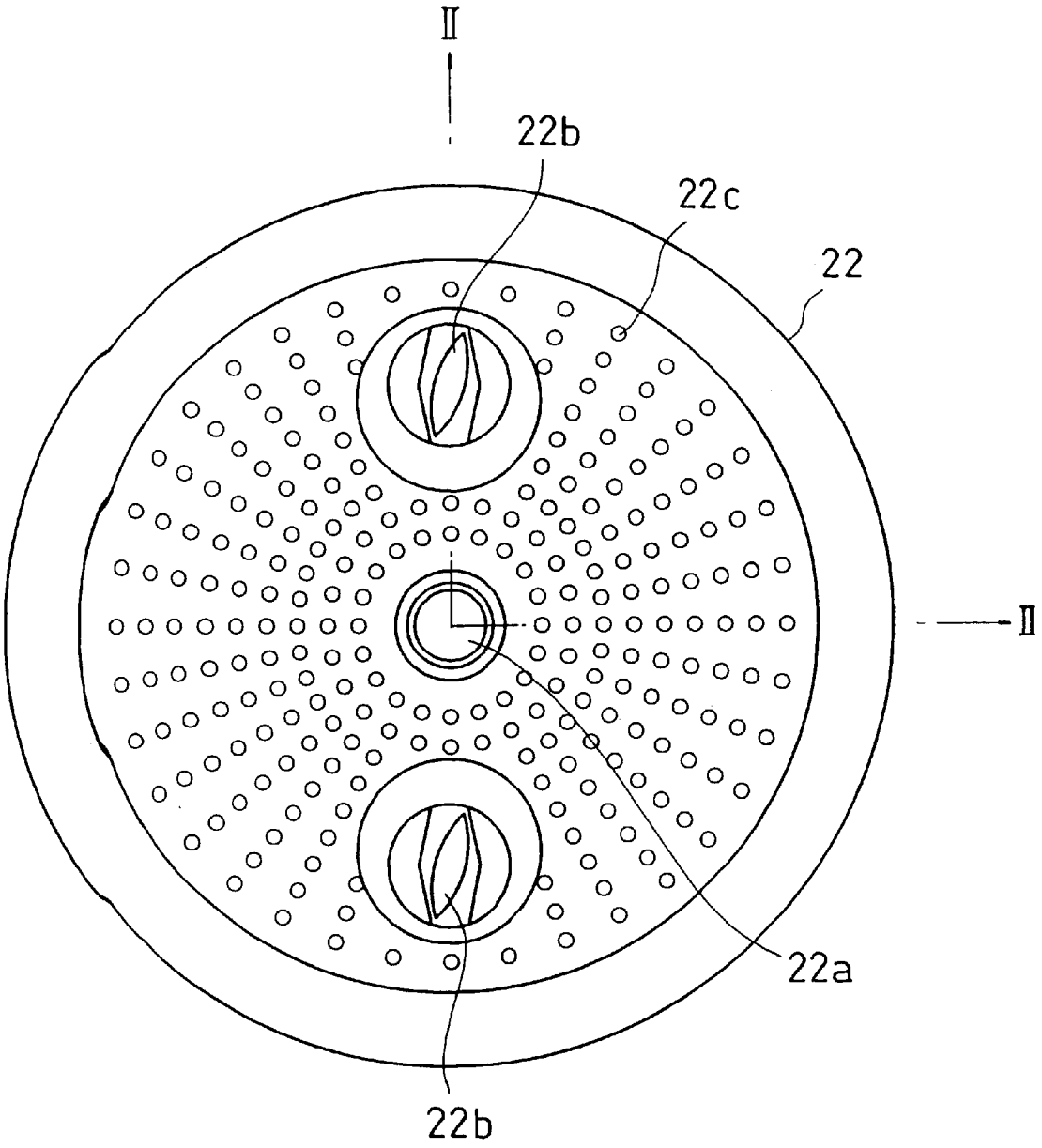

FIGS. 23 to 32 are views showing the sprinkler nozzle according to the third embodiment of the present invention, in which FIGS. 23 to 32 are views in section each showing the tip end portion of the sprinkler nozzle when taken along line II—II of FIG. 32.

FIG. 23 is the view in section of the sprinkler nozzle according to the third embodiment, which in turn has the structure similar to that of the sprinkler nozzle according to the second embodiment with the exception that a shape of the sprinkling plate 22 mounted on the tip end of the sprinkler nozzle is varied so as to enable sprinkling water in different states. Further, the sprinkler nozzle according to this embodiment is provided with no flow amount adjustment mechanism 52.

More specifically, the sprinkler nozzle according to this embodiment uses a sprinkling plate 22 as shown in FIG. 32. The sprinkling plate 22 is composed of a porous plate of a disk shape with a number of sprinkling small opening holes disposed over the approximately entire area thereof. In a central position of the porous plate, there is provided a communicating hole 22*a* so as to communicate with a nozzle outlet 23 formed at the tip end of an inside inner cylinder 17*e* and two of holes, each being elongated narrowly and long and in a shape of a fan, are further provided in positions symmetrical with respect to the communicating holes 22*a*.

Further, the center lines of the narrowly and long elongated and inclining holes in the form of a folding fan are disposed so as to become parallel to each other. The communicating holes 22*a* is disposed so as to communicate with the inner flow path 18 and the fan-shaped holes acting as the first sprinkling outlets 22*b* are disposed so as to communicate with the intermediate flow path 12, while the sprinkling small holes acting as the second sprinkling outlets 22*c* are disposed communicating with the outer flow path 21.

With this arrangement as described hereinabove, water can be sprinkled in a variety of sprinkling patterns as will be described hereinafter by supplying water to the nozzle body 10 from a tap of city water and moving the nozzle body 10 in the forward and backward directions by effecting the operation of turning the outermost cylinder-shaped portion 20.

More specifically, as shown in FIG. 24, water can be flown in the inflow hole 41 from the through hole 13 via the inner flow path 18 and sprinkled in a mist state containing water sprinkled in a straight direction from the tip end of the nozzle head portion 40 by causing the outer peripheral side surface of the nozzle head portion 40 to abut with the inner peripheral side surface of the nozzle outlet 23 and closing the rear end of the inner flow path 18.

Then, as the nozzle body 10 is allowed to move to some extent in the backward direction, a gap is somewhat caused to be formed between the nozzle outlet 23 and the nozzle head portion 40 and the rear end of the inner flow path 18 is opened to a small extent, as shown in FIG. 25. In this case, the water is sprinkled from the tip end of the nozzle head portion 40 in a mist form containing the water sprinkled in a straight direction. In this instance, as the water sprinkled in such a mist state contains the water sprinkled in a straight direction at a central portion of the sprinkled water from the tip end of the nozzle head portion 40, the water can be sprinkled in a long distance and the water is prevented from being sprinkled with its central portion remained hollow without sprinkling water.

Thereafter, as the nozzle body 10 is moved further backward and the flat surface 23*a* of the nozzle outlet 23 reaches the position facing the outer periphery at the tip end of the tip end expansion part 40, as shown in FIG. 26, the water is sprinkled in a straight rod-shaped form from the corresponding gap formed in that position.

As the nozzle body 10 is moved furthermore backward, as shown in FIG. 27, the through hole 13 of the nozzle body 10 is caused to be blocked entirely by the outer peripheral surface of the forward rear-stage inner cylinder 17*c* and the sprinkling of the water is stopped.

Then, when the nozzle body 10 is further moved in the backward direction, as shown in FIG. 28, the through hole 13 of the nozzle body 10 is allowed to communicate with the outer flow path 21 via the communicating path 19*b* so as to reduce a communicating gap thereof, thereby enabling sprinkling the water from the first sprinkling outlets 22*b* (sprinkling small holes) of the sprinkling plate 22, as sprinkled from a watering pot.

Then, as the nozzle body 10 is moved further in the backward direction and the communicating area of the through hole 13 and the outer flow path 21 is increased, as shown in FIG. 29, the water can be sprinkled in a shower form from the first sprinkling outlets 22*b* (sprinkling small holes) of the sprinkling plate 22.

Thereafter, the nozzle body 10 can be further moved in the backward direction, as shown in FIG. 30, the through hole 13 of the nozzle body 10 is entirely closed by the outer peripheral surface of the backward rear-stage inner cylinder 17*d* and the sprinkling of the water is again stopped.

As the nozzle body 10 is moved further in the backward direction from this position, as shown in FIG. 31, the through hole 13 of the nozzle body 10 is allowed to communicate with the intermediate flow path 12 via the communicating path 19*a*, the water is sprinkled from the second sprinkling outlets 22*c* (narrowly elongated holes) of the sprinkling plate 22 in a fan-shaped form.

Moreover, the variety of the sprinkling patterns as described hereinabove can be selected optionally by moving the nozzle body 10 forwards to an appropriate position once the nozzle body 10 has been moved backward.

INDUSTRIAL UTILIZABILITY

The present invention provides the sprinkler nozzle in which an outer periphery of the nozzle body is surrounded by the inner cylinder, an inner flow path and an outer flow path are formed on the inner periphery and on the outer periphery of the inner cylinder, a through hole is formed on the peripheral wall of the inner cylinder so as to match with the position that can communicate with the inner flow path and the outer flow path selectively by operating the forward or backward movement of the inner cylinder, and the nozzle body is provided at its closed tip end with the nozzle head portion part having the inflow hole at its peripheral wall so as to communicate with the inner flow path disposed inside the inner cylinder.

With this arrangement, water can be sprinkled by the operation of the inner cylinder in a sprinkling pattern in various forms, such as, a mist form, a straight rod-shaped form, a cone-shaped form, a watering pot-shaped form or in a shower form. Particularly when it is sprinkled in the sprinkling pattern such as in a mist form or a cone-shaped form, the water supplied through the inflow hole to the sprinkling central portion from the inner flow path can be sprayed in such a state as to fill the sprinkling central portion with no water sprinkled from the tip end of the tip end expansion part, thereby enabling the hollow central portion to be filled with the sprinkling water and extending the sprinkling distance of the sprinkling water around the central portion by the action of the water force of the water sprinkling in a straight direction.

Further, the present invention provides the sprinkler nozzle which is structured in such a manner that the outer peripheral side of the nozzle body is surrounded by the inner cylinder, the inner cylinder is composed of the inside inner cylinder holding, the inner flow path on the outer peripheral side of the nozzle body and the outside inner cylinder holding the intermediate flow path on the outer peripheral side of the inside inner cylinder, the outer flow path is provided on the outer peripheral aide of the outside inner cylinder, the inner flow path, the intermediate flow path or the outer flow path can be communicated with the nozzle body selectively by the operation for the forward or backward movement of the nozzle body, and the nozzle head portion part having the water inflow hole is mounted on the closed tip end of the nozzle body so as to allow the water inflow hole to be communicated with the inner flow path within the inner cylinder.

With this arrangement as described hereinabove, water can further be sprinkled in a sprinkling pattern such as in a circular form or in a fan-shaped form, in addition to the sprinkling patterns such as rod, mist, cone-shape, watering pot-shaped and shower form, by the operation for the forward or backward movement of the nozzle body.

Further, as the inner cylinder is divided into two sections with the front-stage inner cylinder disposed so as to be detachable, the front-stage inner cylinder of the inner cylinder can be detached in case where the tip end portion of the nozzle body causes clogging or is damaged, thereby allowing the tip end expansion part to be exposed to the outside and enabling maintenance to be implemented with ease. This serves as improving maintenance performance.

Moreover, as the partition of each flow path of the inner flow path, the intermediate flow path and the outer flow path can be implemented in a definite manner, the sprinkler nozzle can sprinkle water in various sprinkling patterns and further it can reduce a load to water flowing in the direction in which the water is sprinkled, thereby allowing a smooth sprinkling of water.

I claim:

1. A sprinkler nozzle comprising:

a hollow nozzle body (10) in a cylinder shape with a base end thereof communicating with a hose connection part (2);

wherein the nozzle body (10) is disposed with a tip end portion thereof closed and an outer peripheral side of the nozzle body (10) is surrounded by an inner cylinder (17) disposed so as to move in forward and backward directions while holding an inner flow path (18) as a water flow space;

wherein a cylinder-shaped nozzle head portion (40) with a tip end thereof disposed so as to converge is screwed ahead of a closed portion **(10*b*) of the nozzle body (10) in such a manner that the nozzle head portion (40) is provided on a peripheral wall thereof with a predetermined number of inflow holes (41) communicating with the inner flow path (18), a partition wall (48) for forming a water flow path communicating with the inflow holes (41) is projected at the tip end of the closed portion (10*b*) of the nozzle body (10), the inner flow path (18) is disposed at a rear end thereof so as to communicate with a nozzle outlet (23) disposed at a tip end of the inner cylinder (17), and an inner peripheral side surface of the nozzle outlet (23) is formed by a flat surface section (23*a*) and a tapered surface section (23*b*), wherein an interval between an outer peripheral side surface of the nozzle head portion (40) and the nozzle outlet (23) is disposed so as to be adjusted to a mode including a closing mode by operation for a forward or backward movement of the inner cylinder (17)**;

wherein the nozzle body (10) is further provided at an intermediate peripheral wall thereof with a through hole (13) so as to communicate with the inner flow path (18) upon the forward or backward movement of the inner cylinder (17) and on an outer peripheral side surface ahead and behind of the through hole (13) with a first sealing member (14) and a second sealing member (15), respectively, so as to be tightly engageable with an inner peripheral wall surface of the inner cylinder (17) disposed so as to be movable in forward and backward directions and the through hole (13) is disposed so as to be closable by the inner peripheral wall surface of the inner cylinder (17) engaged tightly with the first sealing member (14) and the second sealing member (15); and wherein the inner cylinder (17) is surrounded at an outer peripheral side thereof integrally by an outermost cylinder portion (20) while holding an outer flow path (21) as a water flow space in such a manner that the outer flow path (21) is disposed so as to communicate with the through hole (13) of the nozzle body (10) upon the forward or backward movement of the inner cylinder (17) and the outermost cylinder portion (20) is disposed so as to move in forward and backward directions by the rotation of the outermost cylinder portion (20) in such a state that a base portion of the outermost cylinder portion (20) forming the outer flow path (21) located on the outermost side is screwed with an outside portion of a casing of the nozzle body (10).

2. A sprinkler nozzle comprising:

a hollow nozzle body (10) in a cylinder shape with a base end communicating with a hose connection part (2);

wherein the nozzle body (10) is disposed with a tip end portion thereof closed and a peripheral wall at an inter-mediate portion thereof the nozzle body (10) is provided with a through hole (13), an outer peripheral side of the nozzle body (10) is surrounded by an inner cylinder (17), while holding an inner flow path (18) as a water flow space, the nozzle body (10) is further disposed so as to move inside the inner cylinder (17) in forward and backward directions by the aid of a first sealing member (14) and a second sealing member (15) disposed on the outer peripheral side surface thereof ahead and behind the through hole (13), respectively, and the through hole (13) is disposed so as to be closable by the inner peripheral wall surface of the inner cylinder (17) tightly engaged with the first sealing member (14) and the second sealing member (15);

wherein a cylinder-shaped nozzle head portion (40) with a tip end thereof disposed so as to converge is screwed ahead of a closed portion **(10*b*) of the nozzle body (10) in such a manner that the nozzle head portion (40) is provided on a peripheral wall thereof with a predetermined member of inflow holes (41) communicating with the inner flow path (18), a partition wall (48) for forming a water flow path communicating with the inflow holes (41) is projected at the tip end of the closed portion (10*b*) of the nozzle body (10), the inner flow path (18) is disposed at a rear end thereof so as to communicate with a nozzle outlet (23) disposed at a tip end of the inner cylinder (17), and an inner peripheral side surface of the nozzle outlet (23) is formed by a flat surface section (23*a*) and a tapered surface section (23*b*), wherein an interval between an outer peripheral side surface of the nozzle head portion (40) and the nozzle outlet (23) is disposed so as to be adjusted to a mode including a closing mode by operation for a forward or backward movement of the inner cylinder; and wherein the outer peripheral side of the inner cylinder (17) is surrounded by the outermost cylinder portion (20) while holding the outer flow path (21) as a water flow space and the outer flow path (21) is structured so as to communicate with the through hole (13) of the nozzle body (10) by the forward and backward movement of the nozzle body (10), in which the rear end of the outer flow path (21) thereof is disposed so as to communicate with a second sprinkling outlet (22*c*) of the sprinkling plate (22) disposed at the tip portion of the outermost cylinder portion (20) and the outer peripheral side surface at the base portion of the nozzle body (10) disposed so as to be slidable in forward and backward directions is screwed with the base portion of the outermost cylinder portion (20) forming the outer flow path (21), thereby allowing the nozzle body (10) to move in forward and backward directions by the rotation of the outermost cylinder portion (20)**.

3. The sprinkler nozzle as claimed in claim 2, wherein the inner cylinder (17) comprises an inside inner cylinder (17*e*) having the inner flow path (18) as a water flow space disposed on the outer peripheral side of the nozzle body (10) and an outside inner cylinder (17*f*) having an intermediate flow path (12) as a water flow space disposed on the outer peripheral side of the inside inner cylinder (17*e*), in which the intermediate flow path (12) is disposed so as to communicate with the through hole (13) of the nozzle body (10) and with a communicating path (19*a*) disposed in the intermediate flow path (12) by the forward or backward movement of the nozzle body (10) and the outer flow path (21) is disposed so as to communicate with the through hole (13) of the nozzle body (10) and with a communicating path (19*b*) disposed in the outer flow path (21) by the forward or backward movement of the nozzle body (10), whereby water can be flown selectively through the intermediate flow path (12) and the outer flow path (21) and the intermediate flow path (12) is disposed at a read end thereof so as to communicate with the first sprinkling outlet (22*b*) of the sprinkling plate (22) disposed at the tip end of the outside inner cylinder (17*f*).

4. The sprinkler nozzle as claimed in claim 3, wherein the first sprinkling outlet (22*b*) comprises a plurality of sprinkling small holes disposed radially from a center of the sprinkling plate (22) toward an outer periphery thereof and the second sprinkling outlet (22*c*) is disposed at a peripheral edge portion of the sprinkling plate (22).

5. The sprinkler nozzle as claimed in claim 3, wherein the first sprinkling outlet (22*b*) comprises a plurality of holes in a fan-shaped form disposed in a position symmetrical from a center of the sprinkling plate (22) so as to sprinkle water in a fan-shaped form and the second sprinkling outlet (22*c*) comprises a number of sprinkling small holes disposed over an approximately entire area of the sprinkling plate (22).

6. The sprinkler nozzle as claimed in any one of claims 1 to 3, wherein the inner cylinder (17) is divided into a front-stage inner cylinder (17*a*) and a rear-stage inner cylinder (17*b*).

7. The sprinkler nozzle as claimed in any one of claims 1 to 3, wherein the inner cylinder (17) comprises the front-stage inner cylinder (17*a*) and the rear-stage inner cylinder (17*b*) in such a manner that the front-stage inner cylinder (17*a*) is provided on an inner peripheral side surface thereof with ribs (25) at predetermined intervals in a peripheral direction so as to allow the ribs (25) to come into abutment with the first sealing member (14) and so as for a gap between the ribs (25) to form the inner flow path (18), and the rear-stage inner cylinder (17*b*) is provided on an opening edge portion at a tip end thereof with concave portions (27) so as to engage with the ribs (25) provided on the front-stage inner cylinder (17*a*) in such a manner that the ribs (25) are engaged integrally with the concave portions (27) of the rear-stage inner cylinder (17*b*) upon an integral assembly of the front-stage inner cylinder (17*a*) with the rear-stage inner cylinder (17*b*) so as for the front-stage inner cylinder (17*a*) to be detachable.

* * * * *